US007784786B2

(12) United States Patent
Tashiro et al.

(10) Patent No.: US 7,784,786 B2
(45) Date of Patent: Aug. 31, 2010

(54) IMAGE FORMING APPARATUS

(75) Inventors: Yoshiaki Tashiro, Osaka (JP); Hiroshi Inui, Osaka (JP); Mitsutoshi Takemoto, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/266,885

(22) Filed: Nov. 7, 2008

(65) Prior Publication Data

US 2009/0121416 A1 May 14, 2009

(30) Foreign Application Priority Data

Nov. 12, 2007 (JP) ..... 2007-293376
Feb. 6, 2008 (JP) ..... 2008-026975

(51) Int. Cl.
*B65H 5/06* (2006.01)

(52) U.S. Cl. ..... 271/264; 271/273

(58) Field of Classification Search ..... 271/264, 271/273, 225, 162, 9.09
See application file for complete search history.

(56) References Cited

U.S. PATENT DOCUMENTS 7,300,050 B2 * 11/2007 Murakami et al. ..... 271/162
7,416,181 B2 * 8/2008 Murakami et al. ..... 271/162
7,451,972 B2 * 11/2008 Fukada et al. ..... 271/9.09
7,577,394 B2 * 8/2009 Sekiya ..... 399/405
2004/0251609 A1 * 12/2004 Taniguchi ..... 271/225
2005/0073085 A1 * 4/2005 Fukada et al. ..... 271/9.09
2008/0224385 A1 * 9/2008 Takahira et al. ..... 271/225
2008/0251991 A1 * 10/2008 Doyo ..... 271/109
2009/0108518 A1 * 4/2009 Kawashima ..... 271/225
2009/0166966 A1 * 7/2009 Nishikata et al. ..... 271/272

FOREIGN PATENT DOCUMENTS

JP 2004-123393 4/2004

* cited by examiner

*Primary Examiner*—Kaitlin S Joerger
(74) *Attorney, Agent, or Firm*—Gerald E Hespos; Michael J. Porco

(57) ABSTRACT

An image forming apparatus includes: an image forming section, provided in an apparatus body, for forming an image on a sheet; a sheet transport path for transporting the sheet to the image forming section; a closing member, openably and closably mounted to the apparatus body, for exposing the sheet transport path in an opened state thereof; a first guide unit and a second guide unit, disposed along the sheet transport path, for guiding the sheet, the first and the second guide units being operable to shift between a proximate position where the first and the second guide units are close to each other, and an away position where the first and the second guide units are away from each other; and a position shifting mechanism for shifting the position of the second guide unit in association with a shifting operation of the first guide unit.

18 Claims, 13 Drawing Sheets

IMAGE FORMING APPARATUS

BACKGROUND OF THE INVENTION

1. Field of the Invention

The present invention relates to an image forming apparatus that enables to easily remove a jammed sheet, in the case where a sheet to be fed to an image forming section along a transport path is jammed.

2. Description of the Related Art

Heretofore, there has been known a so-called vertical transport type image forming apparatus for transporting a sheet substantially in a vertical direction toward an image forming section, as recited in JP No. 2004-123393A (D1). Generally, the image forming apparatus has a closing member (a side part cover member in D1) which is opened and closed by swinging back and forth about an axis of a support shaft mounted at a lower part on a side wall of the apparatus body and extending in a sheet width direction orthogonal to the sheet transport direction. A sheet transport path is defined between an inner wall of the closing member in a closed state, and a portion of the image forming section opposing to the closing member. A photosensitive drum and a transfer roller are provided at respective appropriate positions on the transport path, as opposed to each other with respect to the transport path.

A sheet dispensed from a sheet storage provided at a lower part of the apparatus body, or manually fed by an operator is transported upwardly along the sheet transport path. Then, a toner image on a surface of the photosensitive drum is transferred to the sheet while the sheet passes a nip portion between the photosensitive drum and the transfer roller. After the transferring operation has been completed, the sheet has the toner image fixed by a heat in a fixing section provided immediately above the photosensitive drum, and then the sheet is discharged outside the apparatus body.

In the vertical transport type image forming apparatus, in the case where a sheet is jammed in the sheet transport path, the operator is allowed to remove the jammed sheet by swinging the closing member about the axis of the support shaft and exposing the jammed sheet.

It is often the case that an image forming apparatus has a manual tray for allowing the operator to feed sheets, in addition to a sheet cassette or cassettes. Generally, the manual tray is provided on a side wall of the apparatus body opposite to the side wall of the apparatus body where the closing member is mounted. A sheet placed on the manual tray is fed from a position above the sheet cassette toward the sheet transport path, and has a transport direction thereof changed from a horizontal direction to a vertical direction by about 90° upon reaching a transport direction changing position, whereby the sheet is transported in the vertical direction.

In the above arrangement, in the case where a sheet is jammed in the vicinity of the transport direction changing position, it is extremely difficult to remove the sheet bent with a substantially right angle from the sheet direction changing position, even if the closing member is opened.

SUMMARY OF THE INVENTION

In view of the above, it is an object of the present invention to an image forming apparatus that enables to easily remove a jammed sheet, in the case where a sheet to be fed to an image forming section along a sheet transport path is jammed.

An image forming apparatus according to an aspect of the invention includes: an image forming section, provided in an apparatus body, for forming an image on a sheet; a sheet transport path for transporting the sheet to the image forming section; a closing member, openably and closably mounted to the apparatus body, for exposing the sheet transport path in an opened state thereof; a first guide unit and a second guide unit, disposed along the sheet transport path, for guiding the sheet, the first guide unit and the second guide unit being operable to shift between a proximate position where the first guide unit and the second guide unit are close to each other, and an away position where the first guide unit and the second guide unit are away from each other; and a position shifting mechanism for shifting the position of the second guide unit in association with a shifting operation of the first guide unit.

According to the above arrangement, in the case where a sheet to be transported to the image forming position in the image forming section via the sheet transport path is jammed in the sheet transport path, the operator is allowed to easily remove the jammed sheet by opening the closing member and exposing the jammed sheet.

In the case where an upstream end of a jammed sheet is stuck in the space between the first guide unit and the second guide unit, in response to shifting the first guide unit from the proximate position to the away position, the position shifting mechanism is operable to shift the second guide unit to the away position where the second guide unit is away from the first guide unit in association with the shifting operation of the first guide unit. Thereby, the image forming apparatus is brought to a condition that the sheet jammed during the operation of shifting the first guide unit and the second guide unit to the away position is easily removable. This arrangement allows the operator to easily remove the jammed sheet by pulling the sheet from the space between the first guide unit and the second guide unit.

These and other objects, features and advantages of the present invention will become more apparent upon reading the following detailed description along with the accompanying drawings.

DETAILED DESCRIPTION OF THE PREFERRED EMBODIMENTS

Figure 1:
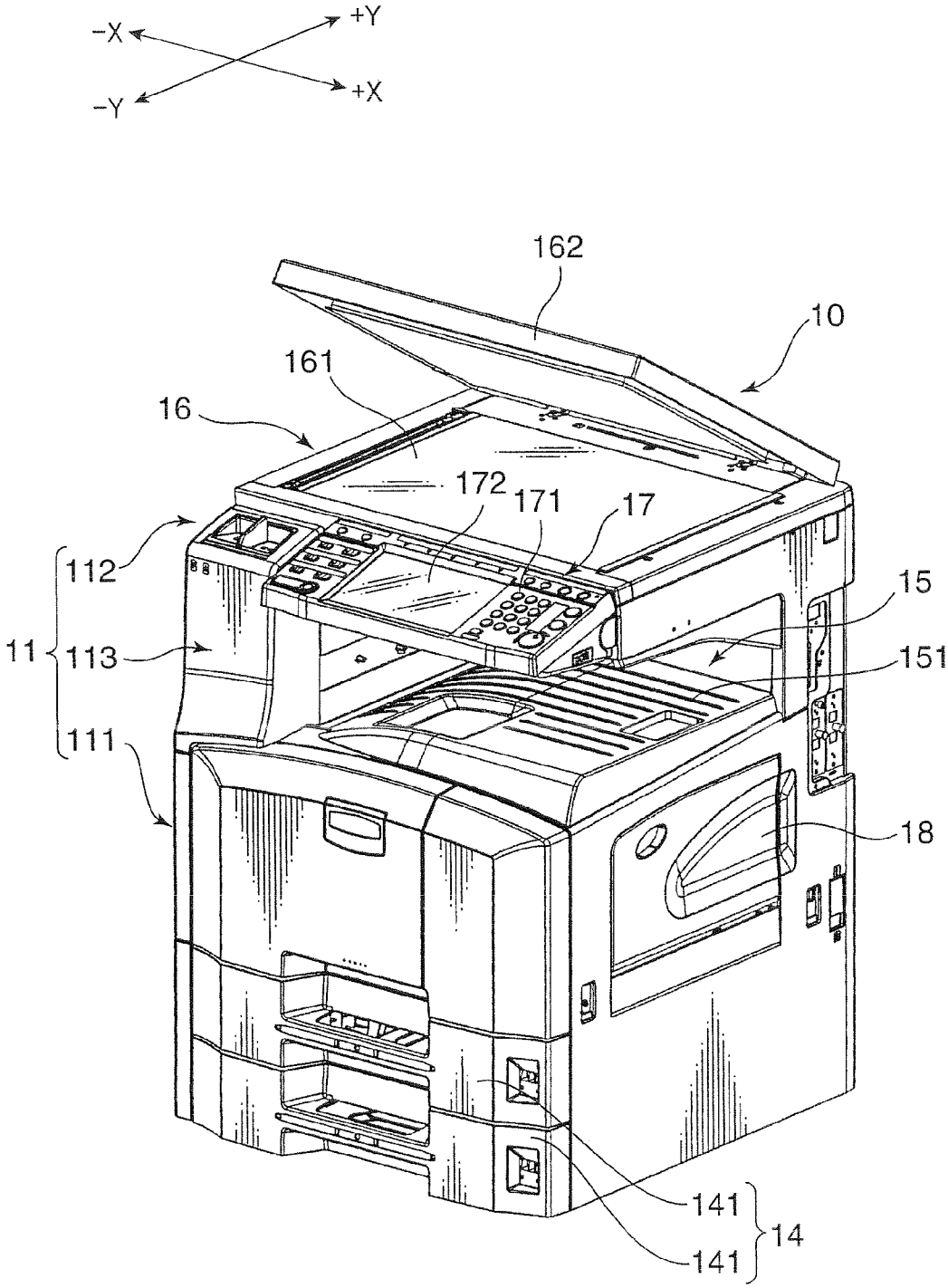
FIG. 1 is a perspective front view of an image forming apparatus embodying the invention, wherein the image forming apparatus has a first guide unit and a second guide unit.
Figure 2:
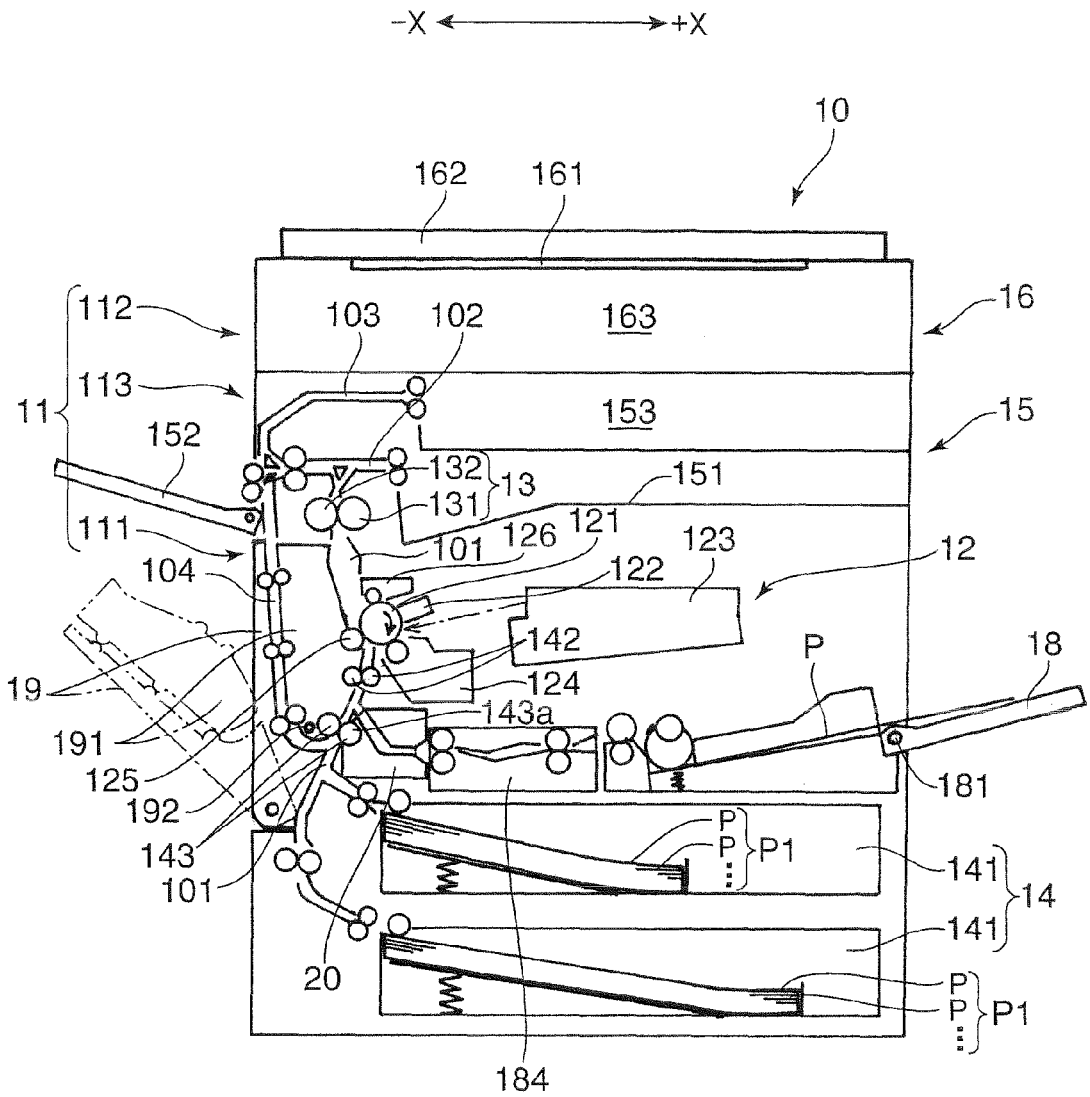
FIG. 2 is an elevational front view of an internal structure of the image forming apparatus shown in FIG. 1.
Figure 3:
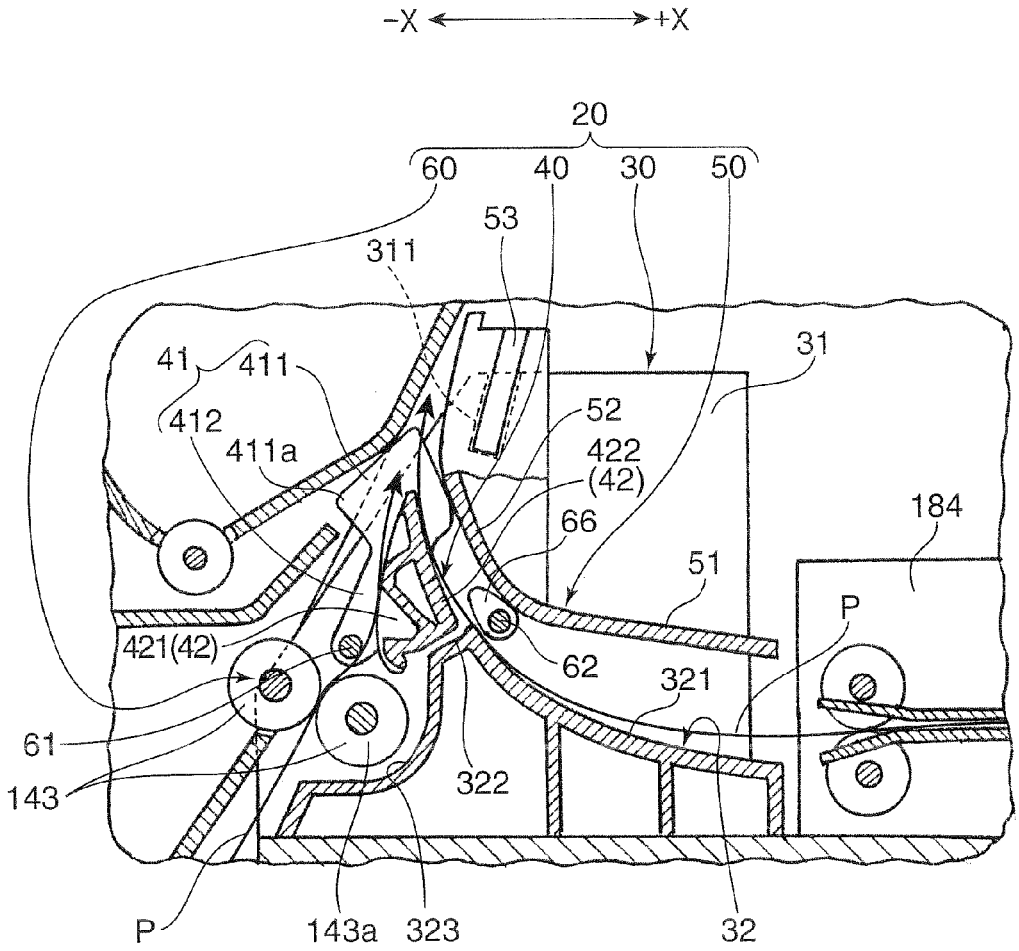
FIG. 3 is a partially enlarged view of the image forming apparatus shown in FIG. 2.

FIG. 1 is a perspective front view of an image forming apparatus embodying the invention, wherein the image forming apparatus is provided with a first guide unit and a second guide unit. FIG. 2 is an elevational front view of an internal structure of the image forming apparatus shown in FIG. 1. FIG. 3 is a partially enlarged view of the image forming apparatus shown in FIG. 2, specifically, showing a relay unit 20 in accordance with a first embodiment of the invention. In FIGS. 1 through 3, X-X directions indicate leftward and rightward directions, wherein −X direction indicates leftward direction, +X direction indicates rightward direction; and Y-Y directions indicate forward and backward directions, wherein −Y direction indicates forward direction, and +Y direction indicates backward direction.

First, the entire arrangement of an image forming apparatus 10 is described based on FIGS. 1 and 2, and referring to FIG. 3 according to needs. The image forming apparatus 10 as illustrated in the embodiment is a copier of so-called internal discharge type, and includes, in an apparatus body 11 thereof, an image forming section 12 (see FIG. 2), a fixing section 13 (see FIG. 2), a sheet storing section 14, a sheet discharging section 15, an image reading section 16, and an operating section 17. The sheet discharging section 15 is formed by indenting a part of the apparatus body 11 below the image reading section 16. In this context, the image forming apparatus 10 is called the internal discharge type.

The apparatus body 11 includes a lower part body 111 of a substantially rectangular parallelepiped shape in external view, an upper part body 112 of a substantially flat parallelepiped shape disposed above and opposite to the lower part body 111, and a connecting part 113 extending between the upper part body 112 and the lower part body 111. The connecting part 113 is a structural member for linking the lower part body 111 and the upper part body 112, with the sheet discharging section 15 defined between the lower part body 111 and the upper part body 112. The connecting part 113 extends upright from a left part of the lower part body 111. A left part of the upper part body 112 is supported on an upper end of the connecting part 113.

The image forming section 12, the fixing section 13, and the sheet storing section 14 are provided in the lower part body 111, and the image reading section 16 is mounted on the upper part body 112. In this embodiment, as show in FIG. 1, the operating section 17 projects in forward direction from a front end of the upper part body 112.

The sheet storing section 14 includes sheet cassettes 141 detachably mounted in the apparatus body 11. A sheet stack P1 (see FIG. 2) is stored in each of the sheet cassettes 141. When an image forming operation is performed, a sheet P is dispensed from the sheet stack P1, and fed to the image forming section 12 where an image is formed or printed on the sheet P. In this embodiment, two sheet cassettes 141 are provided.

The sheet discharging section 15 is defined between the lower part body 111 and the upper part body 112. The sheet discharging section 15 includes an internal discharge tray 151 formed of an upper wall of the lower part body 111. After the toner image has been transferred in the image forming section 12, the sheet P is discharged from a lower part of the connecting part 113 onto the internal discharge tray 151.

The image reading section 16 includes a contact glass platen 161, mounted in an opening in an upper wall of the upper part body 112, for placing a document; an openable/closable document pressing cover 162 for firmly holding the document on the contact glass platen 161; and a scan mechanism 163 (see FIG. 2) for scanning an image of the document on the contact glass platen 161.

Analog information of the document image read by the scan mechanism 163 is converted into a digital signal, and the digital signal is outputted to an exposure unit 123 to be described later for an image forming operation.

The operating section 17 allows the operator to input information relating to an image forming operation to operate the image forming apparatus 10. The operating section 17 is provided with a ten key 171 (see FIG. 1) for allowing the operator to input the number of sheets P for image formation and the like, various operation keys, and a LCD (Liquid Crystal Display) 172 (see FIG. 1) for allowing the operator to perform a touch input.

A manual tray 18 is mounted on a right wall of the lower part body 111 at a position immediately above the sheet storing section 14. The manual tray 18 is pivotally supported at a lower part thereof about an axis of a support shaft 181 to be shiftable between a close posture where the manual tray 18 stands upright to close an opening for manual feeding; and an open posture where the manual tray 18 projects in rightward direction. When the manual tray 18 is shifted to the open posture, the operator is allowed to manually feed sheets P.

A transport unit 184 (see FIG. 2), and a relay unit 20 (see FIGS. 2 and 3) equipped with a first guide unit 40 and a second guide unit 50 of the embodiment are provided between the manual tray 18 and a vertical transport path 101 (see FIG. 2) as a sheet transport path or a first transport path. A sheet P (see FIG. 2) fed from the manual tray 18 is introduced to the vertical transport path 101 via the transport unit 184 and the relay unit 20, guided upwardly along the vertical transport path 101, and fed toward a nip portion between a photosensitive drum 121 and a transport roller 125 to be described later. A sheet transport path from the manual tray 18 to the vertical transport path 101 constitutes a second transport path.

An openable/closable maintenance door (closing member) 19 for use in maintenance service is mounted on a left wall of the lower part body 111. An openable/closable external discharge tray 152 is mounted at a position immediately above the maintenance door 19. After a printing operation has been completed in the image forming section 12, the sheet P is selectively discharged on one of the external discharge tray 152 and the internal discharge tray 151.

In the following, an internal structure of the image forming apparatus 10 is described in detail referring to FIG. 2. As shown in FIG. 2, the photosensitive drum 121 is provided substantially at a central part of the image forming section 12. The photosensitive drum 121 has a surface thereof uniformly charged by a charging unit 122 provided immediately to the right of the photosensitive drum 121, while being rotated clockwise about an axis of rotation of the drum.

An electrostatic latent image is formed on the surface of the photosensitive drum 121 by a laser beam from the exposure unit 123, based on image information on the document image read by the image reading section 16. A developing agent (hereinafter, called as "toner") is supplied from a developing unit 124 provided below the photosensitive drum 121 toward the electrostatic latent image. Thereby, a toner image corresponding to the electrostatic latent image is formed on the surface of the photosensitive drum 121.

A sheet P dispensed from one of the sheet cassettes 141 in the sheet storing section 14 and guided upwardly along the vertical transport path 101 extending substantially in vertical direction is fed to the photosensitive drum 121 where a toner image is formed via a registration roller pair 142 in synchronism with the toner image formation. Thereby, the toner image on the surface of the photosensitive drum 121 is transferred to the sheet P by the transfer roller 125 disposed to the left of the photosensitive drum 121 and opposite thereto. The sheet P carrying the transferred toner image is separated from the photosensitive drum 121, and fed to the fixing section 13.

After the toner image has been transferred to the sheet P, the photosensitive drum 121 is continued to be rotated clockwise. Thereby, the surface of the photosensitive drum 121 is cleaned by a cleaning device 126 provided immediately above the photosensitive drum 121. After the cleaning operation has been completed, the photosensitive drum 121 faces the charging unit 122 for a succeeding image forming operation.

The fixing section 13 is internally provided with a fixing roller 131 having an energization heater such as a halogen lamp, and a pressing roller 132 disposed to the left of the fixing roller 131 and opposite thereto. The sheet P fed from the image forming section 12 has the toner image fixed by a heat, while passing a nip portion between the fixing roller 131 and the pressing roller 132.

In the case where single-sided printing is performed, a sheet P carrying a fixed toner image is selectively discharged to one of the internal discharge tray 151 and the external discharge tray 152 in the sheet discharging section 15 via a sheet discharge path 102 defined above the fixing section 13.

On the other hand, in the case where double-sided printing is performed, after a front part of a sheet P carrying a fixed toner image on one surface thereof is temporarily discharged in a space 153 defined above the internal discharge tray 151 along a flip-flop transport path 103 above the sheet discharge path 102, the sheet P is fed backward along an inverting transport path 104 extending substantially in vertical direction in the interior of the maintenance door 19 for inverting the transport direction, and then, the sheet P is fed to the image forming section 12 to print an image on the other surface of the sheet P. After the double-sided printing operation been completed, the sheet P is discharged onto the internal discharge tray 151 or the external discharge tray 152. The maintenance door 19 has a cover member 191 at a position immediately to the right of the inverting transport path 104 and opposite to the left portion of the image forming section 12. The cover member 191 is formed within the right wall of the maintenance door 19. When the maintenance door 19 is set to a close posture, a part of the vertical transport path 101 for transporting a sheet P dispensed from the sheet cassette 141 or manually fed from the manual tray 18 is defined between the right wall of the cover member 191 and the left portion of the image forming section 12.

Mounting the maintenance door 19 having the above arrangement is advantageous in allowing the operator to remove a jammed sheet P by shifting the maintenance door 19 to an open posture and exposing the jammed sheet P, in the case where a sheet is jammed in the vertical transport path 101 corresponding to the left portion of the image forming section 12.

Figure 4:
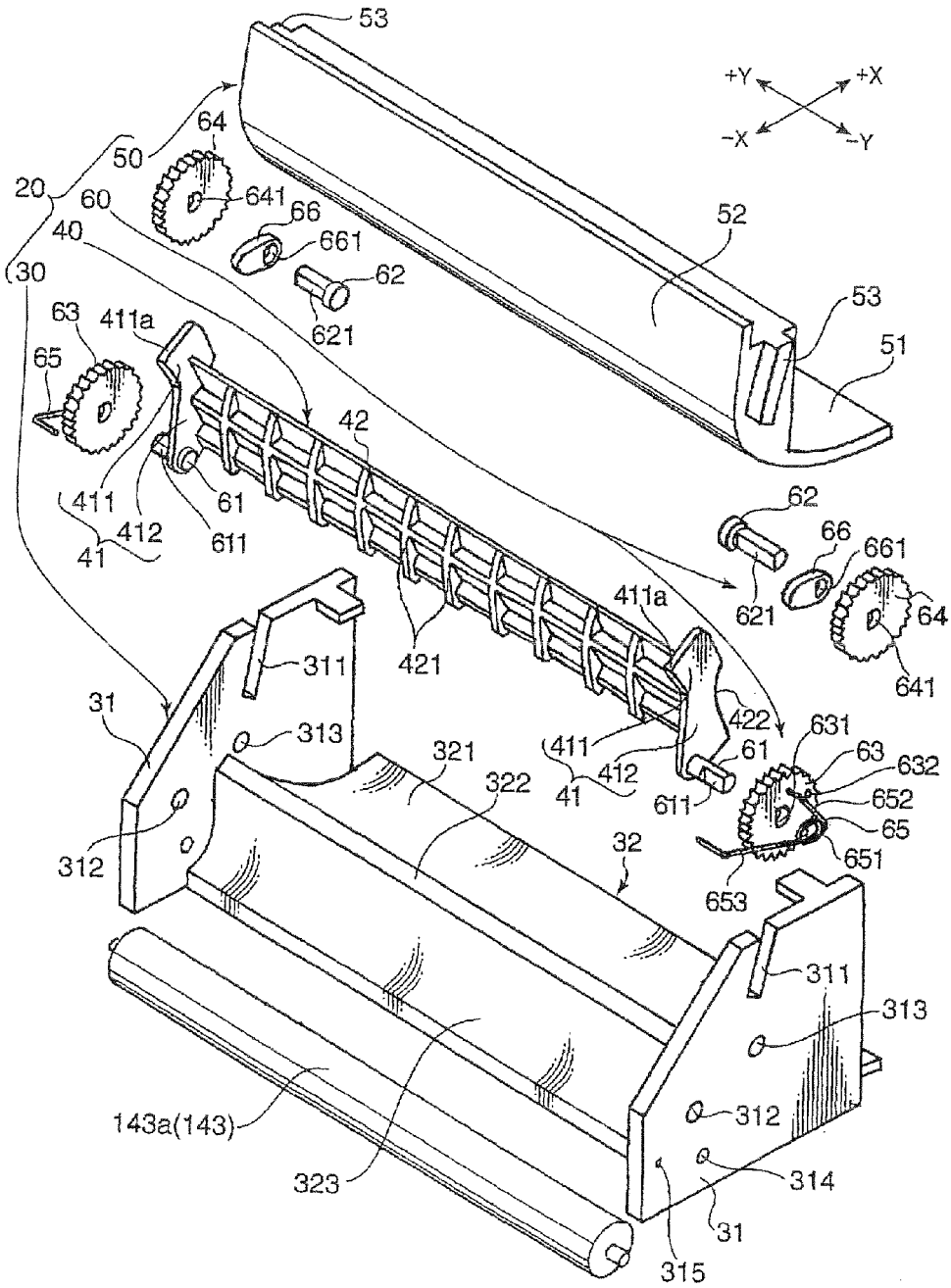
FIG. 4 is an exploded perspective view of a relay unit in accordance with a first embodiment of the invention.
Figure 5:
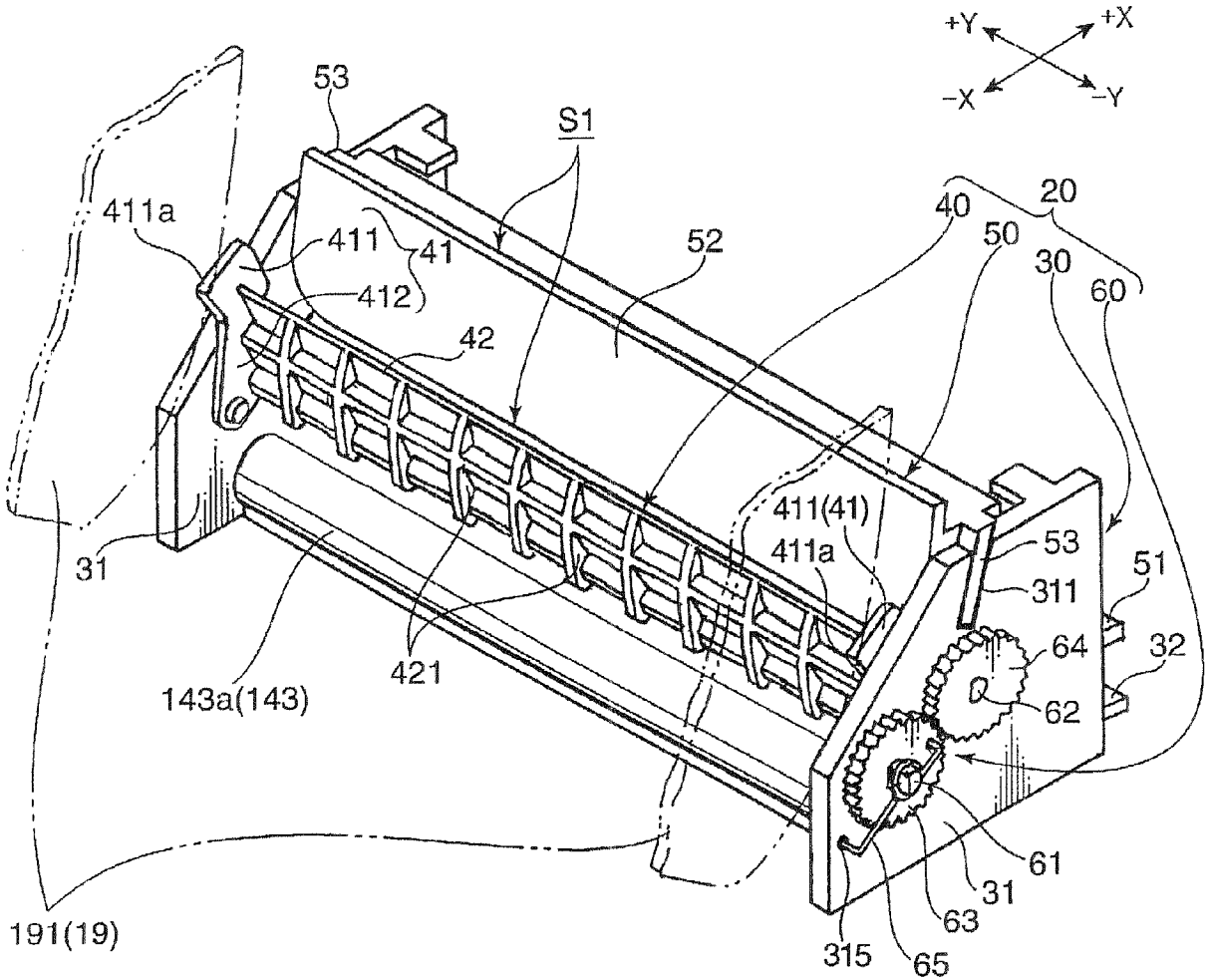
FIG. 5 is an assembled perspective view of the relay unit shown in FIG. 4, specifically showing a state that the first guide unit and the second guide unit are respectively set to a proximity position.
Figure 6:
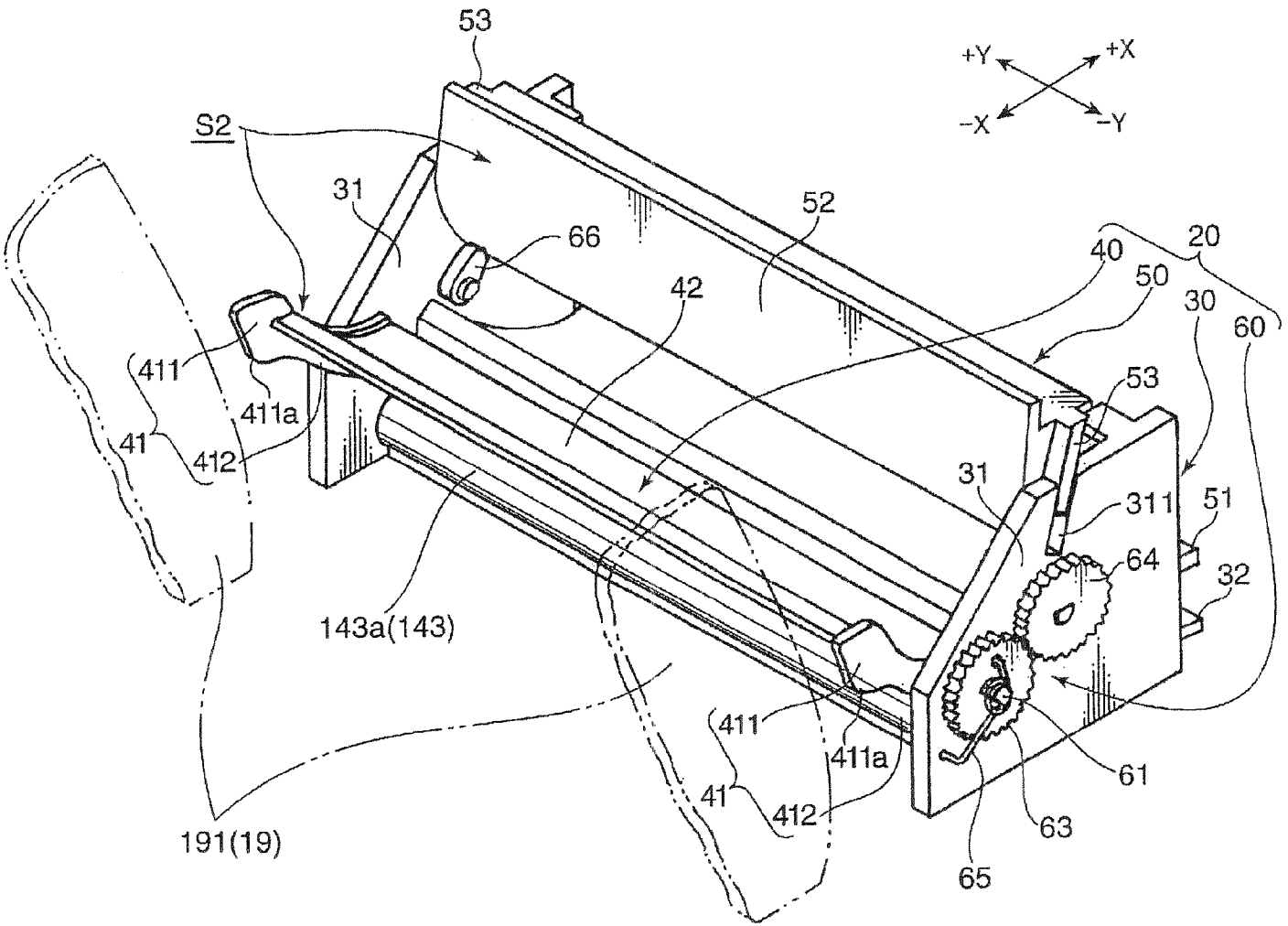
FIG. 6 is an assembled perspective view of the relay unit shown in FIG. 4, specifically showing a state that the first guide unit and the second guide unit are respectively set to an away position.

FIG. 4 is an exploded perspective view of the relay unit 20 in accordance with the first embodiment. FIGS. 5 and 6 are assembled perspective views of the relay unit 20. FIG. 5 shows a state that the first guide unit 40 and the second guide unit 50 are set to a proximity position S1, and FIG. 6 shows a state the first guide unit 40 and the second guide unit 50 are set to an away position S2. The direction indications by the symbols "X" and "Y" in FIGS. 4 through 6 are the same as shown in FIG. 1.

As shown in FIG. 4, the relay unit 20 includes a frame unit 30 fixed in the apparatus body 11, the first guide unit 40 pivotally mounted in the frame unit 30, the second guide unit 50 movable obliquely in vertical direction as opposed to the first guide unit 40, and a position shifting mechanism 60 for shifting the first guide unit 40 and the second guide unit 50 between the proximity position S1 and the away position S2.

The frame unit 30 includes a pair of side frames 31 opposed to each other in forward and backward directions, and a support frame 32 provided at a lower position and between the paired side frames 31. Each of the side frames 31 has a trapezoidal shape, wherein a left end of the side frame 31 is formed into a slope extending obliquely downwardly in leftward direction. In this arrangement, the size of the side frame 31 in leftward and rightward directions is gradually increased, as the side frame 31 extends downwardly.

The support frame 32 has a substantially inverted V-shape in cross section, as viewed in forward direction, with a substantially middle part thereof in leftward and rightward directions formed into a ridge portion 322. The support frame 32 has a right end thereof aligned with lower right corners of the side frames 31. The support frame 32 has a manual-side guide slope 321 extending obliquely upwardly from the right end of the support frame 32 in leftward direction, with a recess formed in an upper surface thereof. A sheet P manually fed via the transport unit 184 is guided upwardly while being transported along the manual-side guide slope 321.

The support frame 32 has a left-side portion 323 on the left side thereof with respect to the ridge portion 322, with an arc-shaped recess indented obliquely downwardly in rightward direction in front view in an upper surface thereof.

Each of the side frames 31 has a guide groove 311 extending downwardly and slightly leftwardly from an upper end thereof. A first through-hole 312 is formed at a left position with respect to the ridge portion 322 in each of the support frames 32, and a second through-hole 313 is formed at an obliquely upper right position with respect to the first through-hole 312 in each of the side frames 31. The first through-holes 312 are adapted to mount a first shaft 61, to be described later, for pivotally supporting the first guide unit 40.

The second through-holes 313 are adapted to mount a second shaft 62, to be described later, for shifting the position of the second guide unit 50.

A roller shaft insertion hole 314 is formed at a position substantially immediately below the corresponding first through-hole 312 in each of the side frames 31. The roller shaft insertion holes 314 are adapted to support a roller shaft of a transport roller 143*a* of a transport roller pair 143 on the side of the relay unit 20.

The first guide unit 40 is adapted to guide a sheet P dispensed from the sheet cassette 141 via the transport roller pair 143 upwardly along the vertical transport path 101, or guide a sheet P manually fed from the manual tray 18 to the vertical transport path 101 while changing the transport direction of the sheet P by about 90°. The first guide unit 40 includes a pair of operated side plates 41 opposed to each other in forward and backward directions, and a guide plate 42 extending between the paired operated side plates 41.

The operated side plates 41 each is constituted of a rhombic-shaped operated portion 411 formed at a top part thereof, and a vertically extending guide plate support portion 412 extending downwardly from a lower part thereof. The operated portion 411 has such a shape that a corner portion (operated corner portion 411*a*) of the operated portion 411 faces leftwardly in a state that the first guide unit 40 is set to the proximity position S1. Front and rear ends (indicated by the two-dotted chain lines in FIG. 5) of the cover member 191 press the operated corner portions 411*a* or its vicinity rightwardly while the maintenance door 19 is closed (see FIG. 2). Thereby, the first guide unit 40 is set to the proximity position S1 where the first guide unit 40 stands substantially upright.

The guide plate 42 has a recess 422 (see FIG. 3) indented obliquely downwardly in leftward direction in a right surface at a vertically middle part thereof. A sheet P fed to the relay unit 20 from the manual tray 18 via the transport unit 184 is transported upwardly while being guided along the recess 422 in the guide plate 42.

Plural guide ribs 421 extending in the sheet transport direction are formed on the left surface of the guide plate 42. A sheet P dispensed from the sheet cassette 141 via the transport roller pair 143 is transported toward the photosensitive drum 121 along the vertical transport path 101 while being guided by the guide ribs 421.

The second guide unit 50 has an arc shape protruding obliquely downwardly in leftward direction, as viewed in forward direction. The second guide unit 50 has a horizontal portion 51 extending substantially horizontally and opposite to the manual-side guide slope 321 of the support frame 32, and a vertical portion 52 extending substantially upwardly from a left end of the horizontal portion 51. An outer corner of a joint portion between the horizontal portion 51 and the vertical portion 52 is formed into an arc-shape protruding obliquely downwardly in leftward direction, as viewed in forward direction.

As shown in FIG. 3, the second guide unit 50 has such dimensions that, in a state that the first guide unit 40 and the second guide unit 50 are respectively set to the proximity position S1, the horizontal portion 51 faces the manual-side guide slope 321 of the frame unit 30 with a slight clearance; and a lower part of the vertical portion 52 faces the guide plate 42 of the first guide unit 40, and an upper part thereof faces the inner wall of the cover member 191 (see FIG. 2) with a slight clearance.

A pair of vertically extending guided projections 53 is formed on front and rear end surfaces of the vertical portion 52 of the second guide unit 50 in directions opposite to each other, respectively. The paired guided projections 53 have such dimensions as to be slidably guided in the guide grooves 311 of the frame unit 30. With this arrangement, guiding the guided projections 53 in the respective corresponding guide grooves 311, as shown in FIG. 5, allows the second guide unit 50 to move to a lowermost position by the weight thereof, and set to the proximity position S1.

The position shifting mechanism 60 includes: the first shaft 61 which is integrally mounted between lower ends of the guide plate support portions 412 of the paired operated side plates 41 of the first guide unit 40, with both ends thereof being slidably received in the first through-holes 312 in the side frames 31 of the frame unit 30; the second shaft 62 having both ends thereof being slidably received in the second through-holes 313 in the side frames 31; a first gear 63 integrally and rotatably mounted on a front end of the first shaft 61; a second gear 64 in mesh with the first gear 63, and integrally and rotatably mounted on a front end of the second shaft 62; a torsion spring (biasing member) 65 for urging the first guide unit 40 toward the away position S2; and position shifting cams 66, integrally and rotatably mounted on both ends of the second shaft 61, respectively, for shifting the guided projections 53 between the proximity position S1 and the away position S2 by forward and backward pivotal movement of the second shaft 62 about the axis thereof.

A D-shaped cutaway portion 611 is formed in the front end of the first shaft 61 by cutting away a part of a surface of the front end. A D-shaped hole 631 corresponding to the D-shaped cut away portion 611 is formed in the middle of the first gear 63. Fixedly mounting the D-shaped cutaway portion 611 in the first through-hole 312 via the D-shaped hole 631 allows the first shaft 61 to integrally rotate with the first gear 63.

A D-shaped cutaway portion 621 is formed in the second shaft 62 by cutting away a part of a surface of the second shaft 62. A D-shaped hole 641 corresponding to the front D-shaped cutaway portion 621 is formed in the middle of the second gear 64. Fixedly mounting the D-shaped cutaway portion 621 in the D-shaped hole 641 allows the second shaft 62 to integrally rotate with the second gear 64.

The torsion spring 65 includes an annular portion 651 to be wound around the first shaft 61, and a first arm 652 and a second arm 653 each drawn from the annular portion 651. The length of the first arm 652 is set slightly smaller than the diameter of the first gear 63. The length of the second arm 653 is set longer than the diameter of the first gear 63.

A gear mounting hole 632 is formed in a front surface of the first gear 63 to receive a lead end of the first arm 652 of the torsion spring 65 which is bent substantially at a right angle. A side-frame mounting hole 315 is formed in the side frame 31 to receive a lead end of the second arm 653 which is bent substantially at a right angle. Mounting the lead end of the first arm 652 in the gear mounting hole 632 in the first gear 63 in a state that the annular portion 651 is wound around the front end of the first shaft 61, and mounting the lead end of the second arm 653 in the side-frame mounting hole 315 allows the torsion spring 65 to be mounted between the first gear 63 and the side frame 31.

The angle between the first arm 652 and the second arm 653 is defined to such a value that the torsion spring 65 is operable to urge the first guide unit 40 toward the away position S2 from the proximity position S1. In this arrangement, in response to closing the maintenance door 19, as shown in FIG. 5, the cover member 191 presses the operated corner portions 411*a* of the operated side plates 41. Thereby, the first guide unit 40 is set to the proximity position S1 against the biasing force of the torsion spring 65. On the other hand, in response to opening the maintenance door 19, the pressing force exerted to the operated side plates 41 by the cover member 191 is released. Thereby, the first guide unit 40 swings counterclockwise about the axis of the first shaft 61 by the biasing force of the torsion spring 65, and is set to the away position S2, as shown in FIG. 6.

The position shifting cams 66 are adapted to shift the second guide unit 50 between the proximity position S1 and the away position S2 by forward and backward pivotal movement thereof about the axis of the second shaft 62. The position shifting cams 66 are mounted on the second shaft 62 at inner walls of the side frames 31, respectively. Each of the position shifting cams 66 has a substantially elliptical shape, and a D-shaped hole 661 is formed at one of the focus positions thereof for receiving the D-shaped cutaway portion 621 of the second shaft 62.

Mounting the D-shaped cutaway portions 621 in the D-shaped holes 661 allows the position shifting cams 66 to be integrally and rotatably coupled to the second shaft 62. The second gear 64 is mounted in a space corresponding to an outwardly projecting portion of the second shaft 62 in a state that the position shifting cams 66 are mounted on the second shaft 62, and the lead end of the second shaft 62 projects outwardly through the second through-hole 313 in the side frame 31.

The phase of the position shifting cam 66 is defined in such a manner that the second guide unit 50 faces leftwardly with respect to the second shaft 62 in a state that the second guide unit 50 is set to the proximity position S1. When the second guide unit 50 is set to the proximity position S1, the front ends of the position shifting cams 66 are aligned with the arc-shaped portion between the horizontal portion 51 and the vertical portion 52 of the second guide unit 50. In this arrangement, in response to clockwise rotation of the second shaft 62 about the axis thereof in a state that the second guide unit 50 is set to the proximity position S1, a bottom portion of the second guide unit 50 is pressed upwardly by left ends of the position shifting cams 66, as the position shifting cams 66 are integrally rotated about the axis of the second shaft 62. Thereby, the second guide unit 50 is shifted to the away position S2 as shown in FIG. 6, while the guided projections 53 are guided in the guide grooves 31.

Figure 7A:
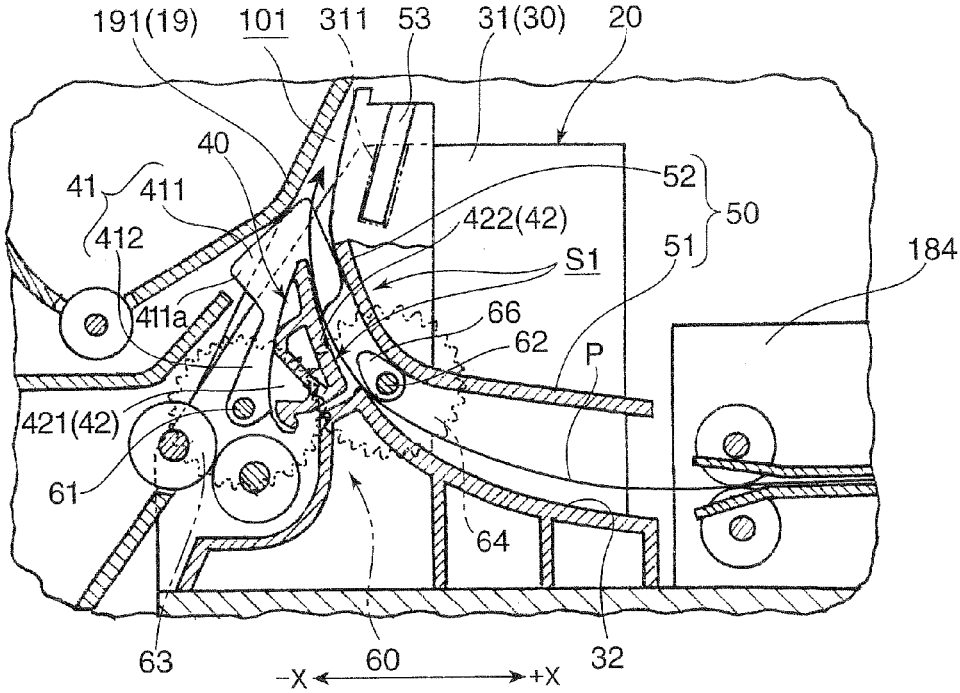
FIG. 7A is a sectional front view for describing an operation of a position shifting mechanism in the relay unit, specifically showing a state that the first guide unit and the second guide unit are respectively set to the proximity position.
Figure 7B:
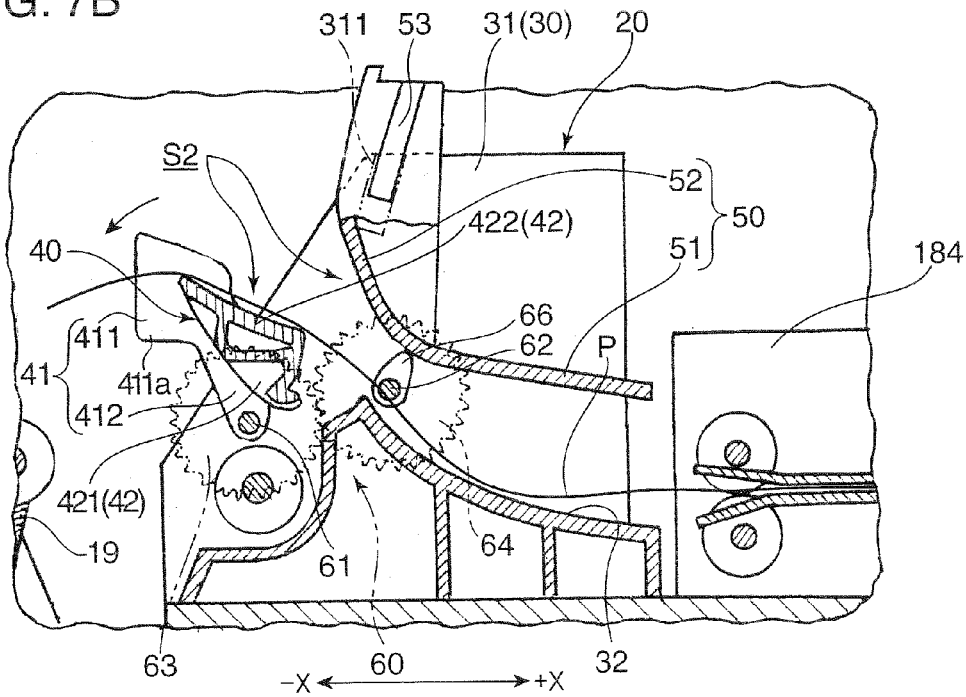
FIG. 7B is a sectional front view for describing an operation of the position shifting mechanism in the relay unit, specifically showing a state that the first guide unit and the second guide unit are respectively set to the away position.

In the following, the operation of the relay unit 20 is described based on FIGS. 7A and 7B, and referring to FIGS. 1 through 6 according to needs. FIGS. 7A and 7B are sectional front views for describing an operation of the position shifting mechanism 60 in the relay unit 20. FIG. 7A shows a state that the first guide unit 40 and the second guide unit 50 are set to the proximity position S1, and FIG. 7B shows a state that the first guide unit 40 and the second guide unit 50 are set to the away position S2. The direction indications by the symbol "X" in FIGS. 7A and 7B are the same as those in FIG. 2. Specifically, −X indicates leftward direction, and +X indicates rightward direction.

As shown in FIG. 7A, in the case where the maintenance door 19 is closed, the cover member 191 presses the operated portions 411 of the operated side plates 41 rightwardly against the biasing force of the torsion spring 65 (see FIG. 5). Thereby, the first guide unit 40 and the second guide unit 50 are respectively set to the proximity position S1. In this state, the recess 422 in the first guide unit 40 comes close to the left surface of the vertical portion 52 of the second guide unit 50. Thereby, a sheet P fed from the transport unit 184 is smoothly guided toward the vertical transport path 101 while being held and guided by the first guide unit 40 and the second guide unit 50.

In the case where the sheet P is jammed in the relay unit 20 or at a position posterior or anterior to the relay unit 20, transport of the sheet P is automatically suspended. Then, the operator is allowed to open the maintenance door 19 to remove the jammed sheet. In response to opening the maintenance door 19, the pressing force exerted to the operated portions 411 of the operated side plates 41 by the cover member 191 is released. Thereby, as shown in FIG. 7B, the first guide unit 40 swings counterclockwise about the axis of the first shaft 61 via the first gear 63 by the biasing force of the torsion spring 65 (see FIG. 6), whereby the first guide unit 40 is shifted from the proximity position S1 to the away position S2.

The clockwise rotation of the first gear 63 about the axis of the first shaft 61 by the biasing force of the torsion spring 65 is transmitted to the second gear 64 in mesh with the first gear 63. Thereby, the second gear 64 is integrally rotated clockwise about the axis of the second shaft 62. Then, the clockwise rotation of the second gear 64 about the axis of the second shaft 62 is transmitted to the position shifting cams 66, and the position shifting cams 66 are pivotally rotated clockwise about the axis of the second shaft 62.

By the pivotal rotation of the position shifting cams 66, the left ends of the position shifting cams 66 press the bottom portion of the second guide unit 50 upwardly. As a result, as shown in FIG. 7B, the second guide unit 50 is shifted from the proximity position S1 to the away position S2, as the guided projections 53 are guided in the guide grooves 311.

Specifically, in response to opening the maintenance door 19 to remove a jammed sheet, the force to open the maintenance door 19 is transmitted to the first guide unit 40 via the operated side plates 41, and to the second guide unit 50 via the first gear 63, the second gear 64, and the position shifting cams 66. Thereby, both of the first guide unit 40 and the second guide unit 50 are shifted from the proximity position S1 to the away position S2. Then, in the case where the first guide unit 40 and the second guide unit 50 are set to the away position S2, as shown in FIG. 7B, a significantly large clearance is defined between the first guide unit 40 and the second guide unit 50. Thereby, the operator is allowed to easily remove the jammed sheet P. The above arrangement contributes to remarkably improving the operability in removing a jammed sheet.

After the jammed sheet has been removed, the maintenance door 19 is closed. In response to closing the maintenance door 19, the right ends of the cover member 191 press the operated side plates 41 of the first guide unit 40 rightwardly. Thereby, the first guide unit 40 swings clockwise about the axis of the first shaft 61, and the second guide unit 50 swings counterclockwise about the axis of the second shaft 62 via the first gear 63, the second gear 64, and the position shifting cams 66. Thereby, the first guide unit 40 and the second guide unit 50 are returned to the proximity position S1 shown in FIG. 7A.

Figure 8:
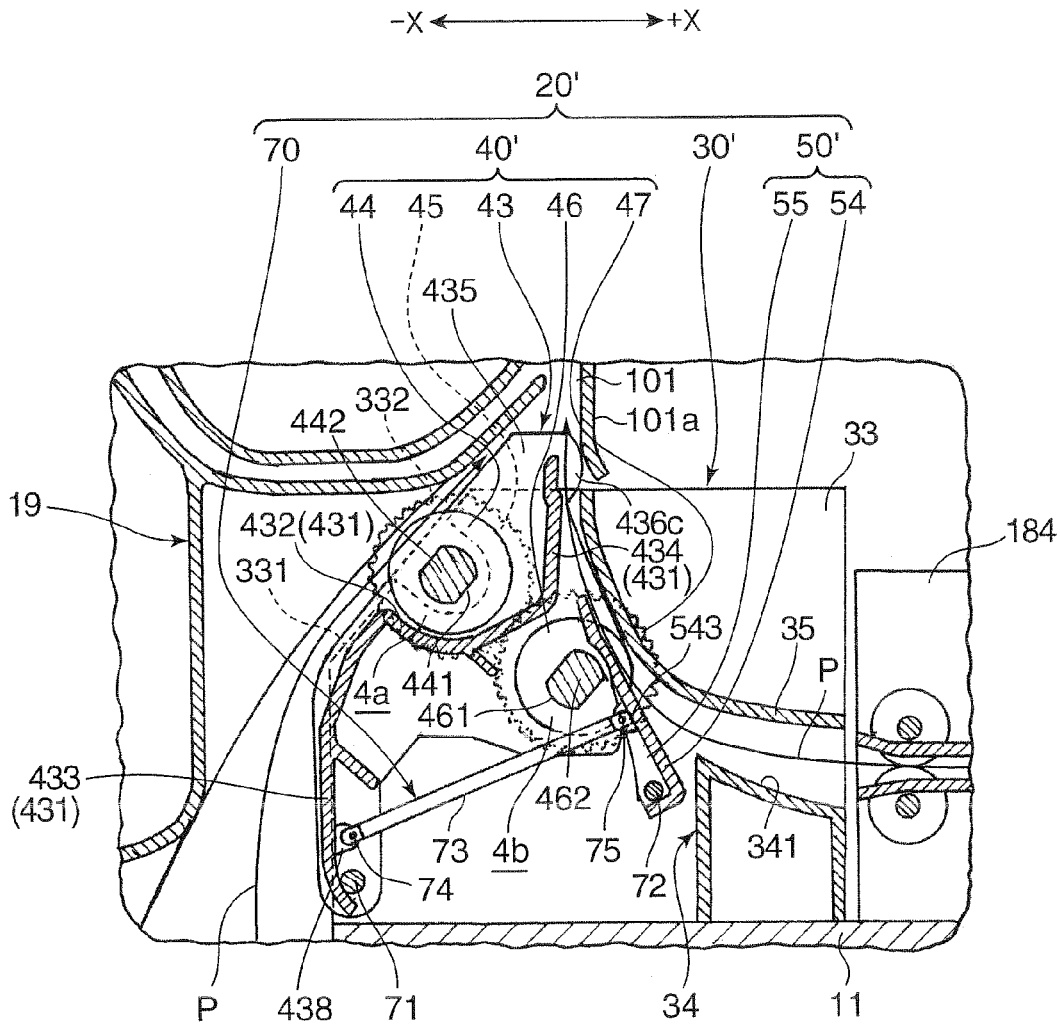
FIG. 8 is a sectional front view of a relay unit in accordance with a second embodiment of the invention.
Figure 9:
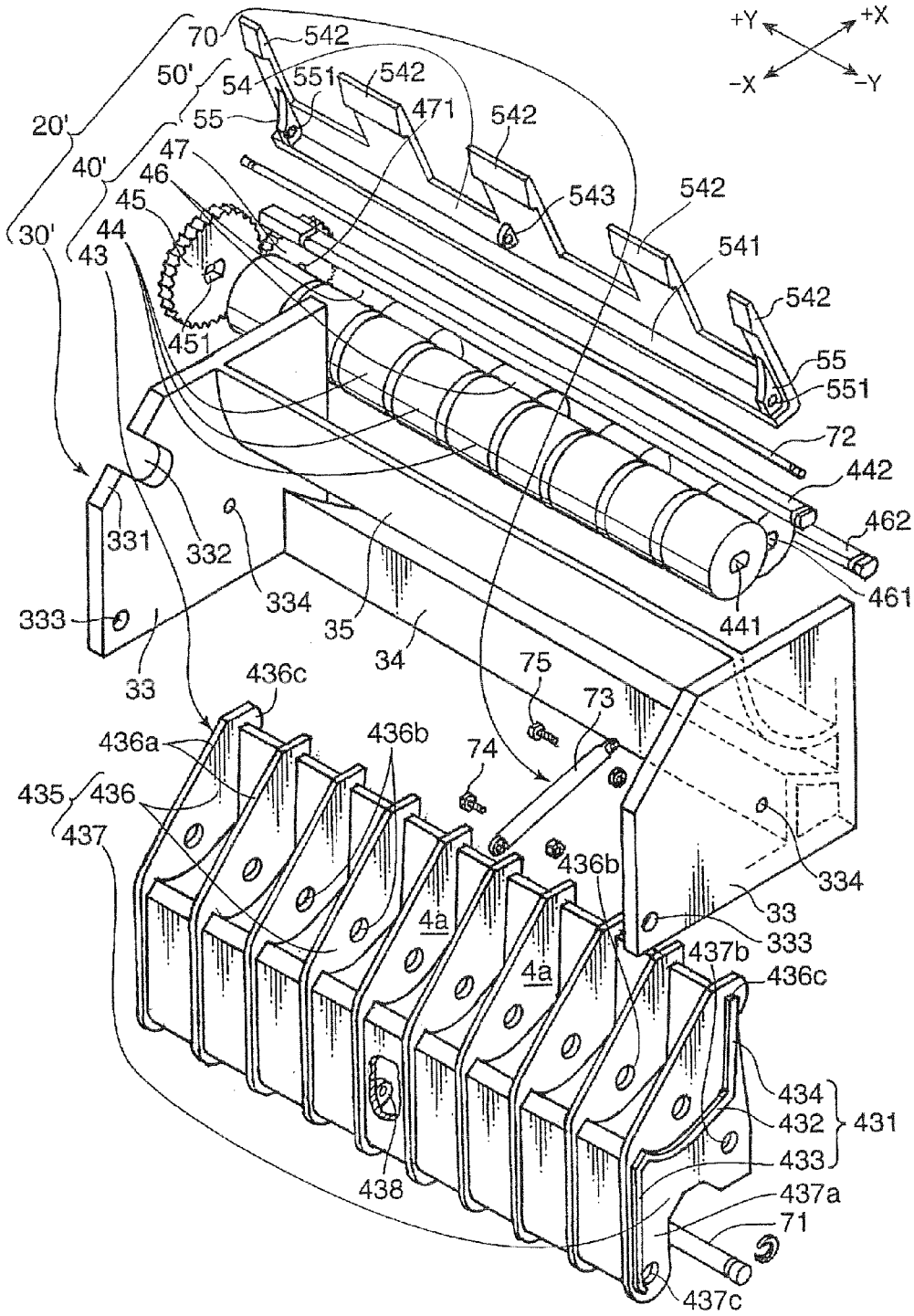
FIG. 9 is a partially cutaway perspective view of the relay unit shown in FIG. 8.
Figure 10:
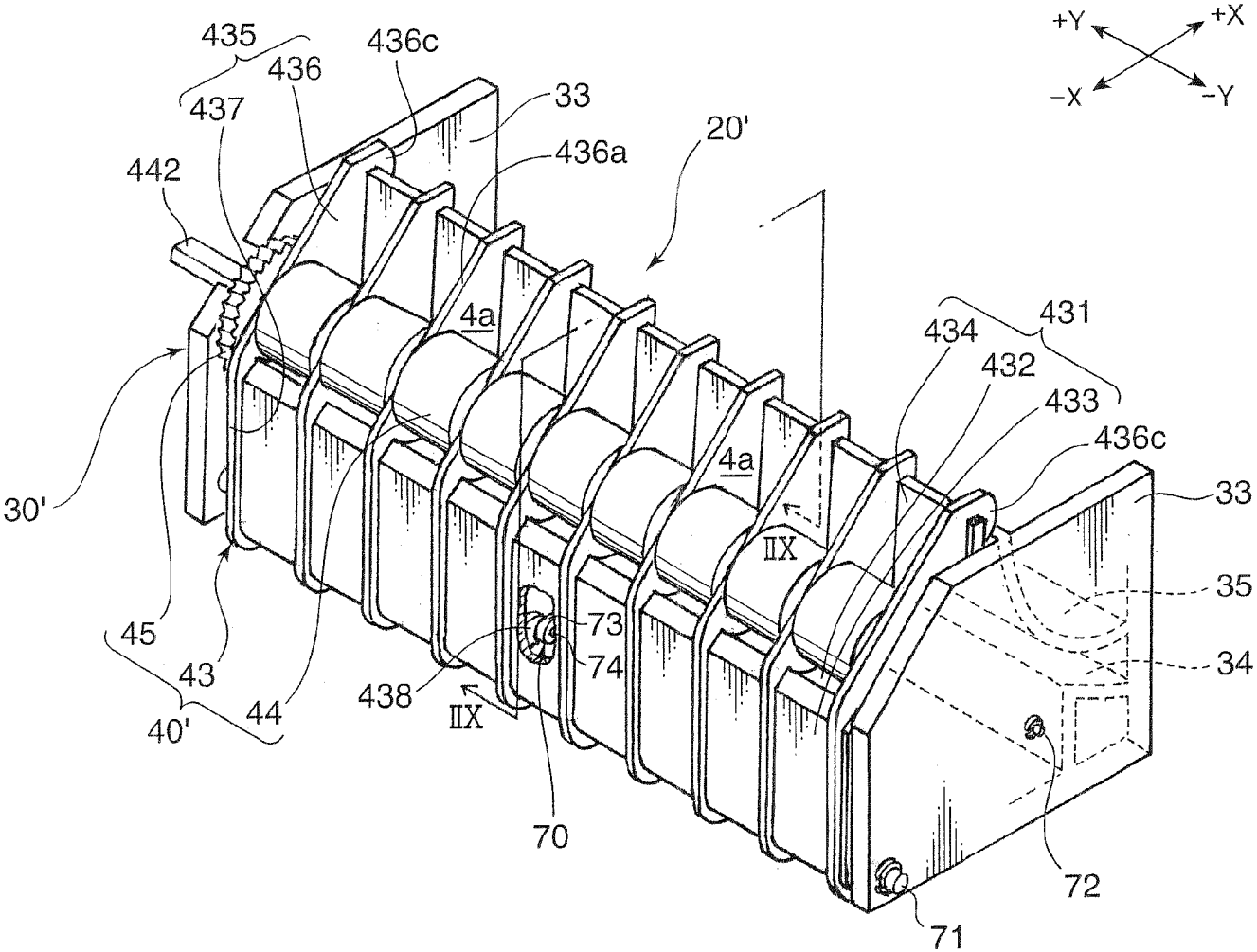
FIG. 10 is an assembled perspective view of the relay unit shown in FIG. 9.

FIG. 8 is a sectional front view (taken along the line IIX-IIX in FIG. 10) of a relay unit 20' in accordance with a second embodiment of the invention. FIGS. 9 and 10 are perspective views of the relay unit 20' shown in FIG. 8, wherein FIG. 9 is an exploded perspective view, and FIG. 10 is an assembled perspective view. The direction indications by the symbols "X" and "Y" in FIGS. 8 through 10 are the same as shown in FIG. 1. Specifically X-X directions indicate leftward and rightward directions, wherein −X direction indicates leftward direction, +X direction indicates rightward direction; and Y-Y directions indicate forward and backward directions, wherein −Y direction indicates forward direction, and +Y direction indicates backward direction.

As shown in FIG. 8, the relay unit 20' in the second embodiment is basically the same as the relay unit 20 in the first embodiment in that the relay unit 20' includes a frame unit 30' fixed in an apparatus body 11, a first guide unit 40' pivotally mounted in the frame unit 30', and a second guide unit 50' mounted to the right of the first guide unit 40' in the frame unit 30', as opposed to the first guide unit 40', except for the detailed arrangement of the first guide unit 40' and the second guide unit 50'.

In the relay unit 20' in the second embodiment, a posture shifting mechanism 70 for shifting the posture of the first guide unit 40' and the second guide unit 50' is employed to allow the first guide unit 40' and the second guide unit 50' to perform a predetermined operation, in place of the position shifting mechanism 60 in the first embodiment. In the following, the first guide unit 40' and the second guide unit 50' are described, and then, the posture shifting mechanism 70 is described.

The frame unit 30' includes a pair of side frames 33 opposed to each other in forward and backward directions, a lower support frame 34 extending between the paired side frames 33 at a right part of the paired side frames 33, and an upper support frame 35 formed above the lower support frame 34 and opposite to the lower support frame 34. The lower support frame 34 has a manual-side guide slope 341 extending obliquely upwardly in leftward direction, with an arc-shaped recess indented obliquely downwardly in leftward direction in an upper surface thereof. A downstream end of the manual-side guide slope 341 faces a lower part of the right wall of the second guide unit 50'.

The upper support frame 35 has a length substantially twice as long as the length of the lower support frame 34 in leftward and rightward directions. The upper support frame 35 has an arc shape protruding toward lower left corners of the side frames 33 in its entirety, with a right half portion thereof opposing to the manual-side guide slope 341 of the lower support frame 34, and a left half portion thereof opposing to an upper part of the right wall of the second guide unit 50'. In this arrangement, a sheet P fed from a transport unit 184 is guided to the clearance between the upper support frame 35 and the lower support frame 34, and is transported to a vertical transport path 101 from a downstream end of the clearance via a clearance between the left surface of the upper support frame 35 and the second guide unit 50', while being guided along the manual-side guide slope 341.

The rear side frame 33 has a cutaway groove 332 extending from a slope surface 331 on an upper left corner thereof toward a lower right corner thereof. As shown in FIG. 8, the cutaway groove 332 is adapted to receive a rear end of a first elliptical shaft 442 to be descried later, in a state that the first guide unit 40' is set to a transport posture.

Left support holes 333 (see FIG. 9) are formed in lower left corners of the front and rear side frames 33, respectively, at positions opposite to each other. Middle support holes 334 are formed substantially in the middle of the front and rear side frames 33 in leftward and rightward directions at positions slightly above the left support holes 333, respectively. The left support holes 333 are adapted to support a first link shaft 71 to be described later. The middle support holes 334 are adapted to support a second link shaft 72 to be described later.

The first guide unit 40' includes: a first guide body 43, disposed opposite to the vertical transport path 101, for guiding a sheet P dispensed from a sheet cassette 141 toward the photosensitive drum 121 (see FIG. 2); a first transport roller 44 mounted at an upper left position of the first guide body 43; a first transport roller gear 45 coaxially mounted on the first transport roller 44 to be integrally rotated with the first transport roller 44; a second transport roller 46 mounted at a lower right corner of the first guide body 43; and a second transport roller gear 47 coaxially mounted on the second transport roller 46 to be integrally rotated with the second transport roller 46, and in mesh with the first transport roller gear 45.

The first transport roller 44 is adapted to transport a sheet P from the sheet cassette 141. The second transport roller 46 is adapted to transport a sheet P fed from a manual tray 18 to the relay unit 20' via the transport unit 184.

The first guide body 43 includes a frame member 431 of a plate-like shape with one step portion in front view, and plural guide fins 435 mounted on the frame member 431. The mounting manner of the guide fins 435 is not limited to the above. Alternatively, in the case where the first guide body 43 is made of a synthetic resin, the frame member 431 and the guide fins 435 may be integrally formed by e.g. injection molding.

The frame member 431 includes an intermediate portion 432 extending in forward and backward directions, with a middle part thereof being indented upwardly; a suspending portion 433 extending downwardly from a left end of the intermediate portion 432; and an upward extension 434 upwardly extending from a right end of the intermediate portion 432.

The guide fins 435 each has such dimensions as to be mounted on the frame member 431. Each of the guide fins 435 has an upper fin portion 436 of a substantially triangular shape at an upper side of the intermediate portion 432, and a lower fin portion 437 of a shape other than the triangular shape at a lower side of the intermediate portion 432.

The upper fin portion 436 has a slope surface **436*a* extending obliquely downwardly in leftward direction. A sheet P from the sheet cassette 141 is guided upwardly along the slope surface 436*a*, while being guided by driving rotation of the first transport roller 44. A first circular hole 436*b* is formed in each of the upper fin portions 436 to receive the first elliptical shaft 442** to be described later.

The foremost upper fin portion 436 and the rearmost upper fin portion 436 have arc-shaped stoppers **436*c* bulging from upper ends thereof in rightward direction, respectively. As shown in FIG. 8, the arc-shaped stoppers 436*c* are abutted against lower ends of a guide wall 101*a* of the vertical transport path 101 on the side of an image forming section 12 in a state that the first guide unit 40' is set to a transport posture. Thereby, a further clockwise swing of the first guide unit 40'** is restrained.

Each of the lower fin portions 437 has a leg portion **437*a* extending downwardly along the suspending portion 433. A pivot center hole 437*c* is formed in a lower end of each of the leg portions 437*a* on the right of the suspending portion 433. The pivot center holes 437*c* are aligned with the left support holes 333, and adapted to receive and support the first link shaft 71 to be described later. Each of the lower fin portions 437 also has a second circular hole 437*b* at a lower right of the intermediate portion 432 for receiving a second elliptical shaft 462** to be described later.

The first transport roller 44 is provided in plural number and has such dimensions that the first transport rollers 44 are respectively mounted in upper roller mounting chambers **4*a* partitioned by the adjacent upper fin portions 436 of the first guide body 43. In this embodiment, the first guide body 43 has ten fins. Accordingly, nine upper roller mounting chambers 4*a* are provided. The number of fins of the first guide body 43 is not limited to ten, but may be less than ten or more than ten. The number of the first transport rollers 44** may be less than nine or more than nine in correspondence to the number of fins.

A first elliptical hole 441 with an elliptical shape is formed in the middle of each of the first transport rollers 44. The first elliptical shaft 442 whose cross sectional shape coincides with the shape of the first elliptical hole 441 is passed through the first elliptical holes 441. The first elliptical shaft 442 has a curvature diameter thereof slightly smaller than the diameter of the first circular hole 436*b*, and a length thereof slightly larger than the outer distance between the paired side frames 33 of the frame unit 30'.

In this arrangement, passing the first elliptical shaft 442 through the first elliptical holes 441 via the first circular holes 436*b* in a state that the first transport rollers 44 are mounted in the respective corresponding upper roller mounting chambers 4*a* allows the first transport rollers 44 to integrally rotate about the axis of the first elliptical shaft 442, in a state that the first transport rollers 44 are mounted in the upper roller mounting chambers 4*a*, as shown in FIG. 10.

In the above state, the first transport roller gear 45 is mounted on the first elliptical shaft 442 at a rear surface of the rearmost upper fin portion 436 to be integrally rotated with the first elliptical shaft 442. Specifically, an elliptical center hole 451 with a shape coincident with the cross sectional shape of the first elliptical shaft 442 is formed in the middle of the first transport roller gear 45. The first elliptical shaft 442 is received in the center hole 451.

C-rings or a like member are mounted on both ends of the first elliptical shaft 442 in a state that the first elliptical shaft 442 is passed through the first transport rollers 44 in the upper roller mounting chambers 4*a*, and through the first transport roller gear 45 to prevent disengagement of the first elliptical shaft 442. A rear end of the first elliptical shaft 442 projects rearwardly through the cutaway groove 332 in the rear side frame 33 in a state that the first guide unit 40' is set to a transport posture, as shown in FIG. 10. The rearwardly projecting rear end of the first elliptical shaft 442 is connected to an unillustrated driving motor via a predetermined coupling member in a state that the first guide body 43 is set to the transport posture. Thereby, a driving force of the driving motor is transmitted to the first transport rollers 44 and the first transport roller gear 45 via the first elliptical shaft 442.

The second transport roller 46 is provided in plural number and has such dimensions that the second transport rollers 46 are respectively mounted in lower roller mounting chambers 4*b* (see FIG. 8) partitioned by the adjacent lower fin portions 437 of the first guide body 43. In this embodiment, the second transport roller 46 is not provided in a space between the lower fin portions 437 at a middle part of the first guide body 43 in forward and backward directions, in view of the construction of the second guide unit 50'. Accordingly, eight lower roller mounting chambers 4*b* are defined between the adjacent lower fin portions 437, wherein four lower roller mounting chambers 4*b* are defined in a front part of the first guide body 43, and four lower roller mounting chambers 4*b* are defined in a rear part of the first guide body 43, except for the middle part thereof.

A second elliptical hole 461 with an elliptical shape is formed in the middle of each of the second transport rollers 46. The second elliptical shaft 462 whose cross sectional shape coincides with the shape of the second elliptical hole 461 is passed through the second elliptical holes 461. The second elliptical shaft 462 has a curvature diameter thereof slightly smaller than the diameter of the second circular hole 437*b*, and a length thereof slightly larger than the outer distance between the paired side frames 33 of the frame unit 30'.

In this arrangement, passing the second elliptical shaft 462 through the second elliptical holes 461 via the second circular holes 437*b* in a state that the second transport rollers 46 are mounted in the respective corresponding lower roller mounting chambers 4*b* allows the second transport rollers 46 to integrally rotate about the axis of the second elliptical shaft 462, in a state that the second transport rollers 46 are mounted in the lower roller mounting chambers 4*b*.

In the above state, the second transport roller gear 47 is mounted on the second elliptical shaft 462 at a rear surface of the rearmost lower fin portion 437 to be integrally rotated with the second elliptical shaft 462. Specifically, an elliptical center hole 471 with a shape coincident with the cross sectional shape of the second elliptical shaft 462 is formed in the middle of the second transport roller gear 47. The second elliptical shaft 462 is received in the center hole 471.

C-rings or a like member are mounted on both ends of the second elliptical shaft 462 in a state that the second elliptical shaft 462 is passed through the second transport rollers 46 in the lower roller mounting chambers 4*b*, and through the second transport roller gear 47 to prevent disengagement of the second elliptical shaft 462. The length of the second elliptical shaft 462 is set slightly smaller than the inner distance between the paired side frames 33 of the frame unit 30'. Accordingly, the second elliptical shaft 462 is mounted between the paired side frames 33 in a state that the first guide unit 40' is set to a transport posture, as shown in FIG. 10.

The second transport roller gear 47 is engaged with the rearmost first transport roller 44. Accordingly, in response to driving the unillustrated driving motor, rotation of the first transport roller gear 45 is transmitted to the second transport roller gear 47. Thereby, the first transport rollers 44 and the second transport rollers 46 are rotated in directions opposite to each other. Specifically, the first transport rollers 44 are rotated clockwise, and the second transport rollers 46 are rotated counterclockwise in FIG. 8.

The second guide unit 50' is pivotally supported about the axis of the second link shaft 72 to be described later. The second guide unit 50' includes an elongated and planar-shaped second guide body 54 extending in forward and backward directions, with a substantially E-shape in plan view; and a pair of brackets 55 fixed at front and rear ends of the second guide body 54, respectively.

The second guide body 54 includes a bent portion 541 formed by bending a base end thereof at a substantially right angle and extending in leftward direction. Forming the bent portion 541 is advantageous in increasing the mechanical strength of the second guide unit 50'. The second guide body 54 further has upwardly projecting extension arms 542 at a front end, a rear end, and a middle part thereof in forward and backward directions, respectively. As shown in FIG. 8, eight second transport rollers 46 are mounted in the clearances between the front extension arm 542, the middle extension arm 542, and the rear extension arm 542 in a state that the second guide unit 50' is set to a transport posture. Specifically, four second transport rollers 46 are mounted in the front clearance between the front extension arm 542 and the middle extension arm 542; and four second transport rollers 46 are mounted in the rear clearance between the middle extension arm 542 and the rear extension arm 542.

The brackets 55 each has a substantially right triangular shape. The brackets 55 are fixedly mounted between the bent portion 541 and the second guide body 54 at front and rear ends of the second guide body 54, respectively. An insertion hole 551 is formed in each of the brackets 55 to receive the second link shaft 72 to be described later.

The posture shifting mechanism 70 is adapted to move the second guide unit 50 in association with a movement of the first guide unit 40'. The posture shifting mechanism 70 includes the first link shaft (first shaft) 71 for pivotally supporting the first guide unit 40' about the axis thereof, the second link shaft (third shaft) 72 for pivotally supporting the second guide unit 50' about the axis thereof, and a linking arm 73 extending between the first guide unit 40' and the second guide unit 50' at a position above a straight line connecting the axes of the first link shaft 71 and the second link shaft 72 to swing the first guide unit 40' and the second guide unit 50' relative to each other.

Front and rear ends of the first link shaft 71 are received in the left support holes 333 in the paired side frames 33 of the frame unit 30' respectively in a state that the first link shaft 71 is passed through the pivot center holes 437*c* in the leg portions 437*a* of the first guide body 43 to prevent disengagement of the first link shaft 71. In this arrangement, the first guide unit 40' is allowed to be shifted between the transport posture shown in FIG. 11A and the open posture shown in FIG. 11B by swinging back and forth about the axis of the first link shaft 71.

Front and rear ends of the second link shaft 72 are received in the middle support holes 334 in the paired side frames 33 of the frame unit 30' respectively in a state that the second link shaft 72 is passed through the insertion holes 551 in the paired brackets 55 attached to the front and rear ends of the second guide body 54 to prevent disengagement of the second link shaft 72. In this arrangement, the second guide unit 50' is allowed to be shifted between the transport posture shown in FIG. 11A and the open posture shown in FIG. 11B by swinging back and forth about the axis of the second link shaft 72.

As shown in FIG. 9, a first bracket 438 of the first guide unit 40' is attached to the suspending portion 433 substantially in the middle of the first guide body 43 in forward and backward directions; and a second bracket 543 of the second guide unit 50' is attached to the middle extension arm 542 of the second guide body 54, as opposed to the first bracket 438. The linking arm 73 extends between the first bracket 438 and the second bracket 543.

A left end of the linking arm 73 is pivotally supported about the axis of a third link shaft 74 passing through the first bracket 438. A right end of the linking arm 73 is pivotally supported about the axis of a fourth link shaft 75 passing through the second bracket 543. Thus, the posture shifting mechanism 70 is configured into a four-sided link structure constituted of a portion of the side frames 33 between the first link shaft 71 and the second link shaft 72, a portion of the leg portions 437*a* of the first guide body 43 between the first link shaft 71 and the third link shaft 74, and a portion of the second guide body 54 between the second link shaft 72 and the fourth link shaft 75.

Figure 11A:
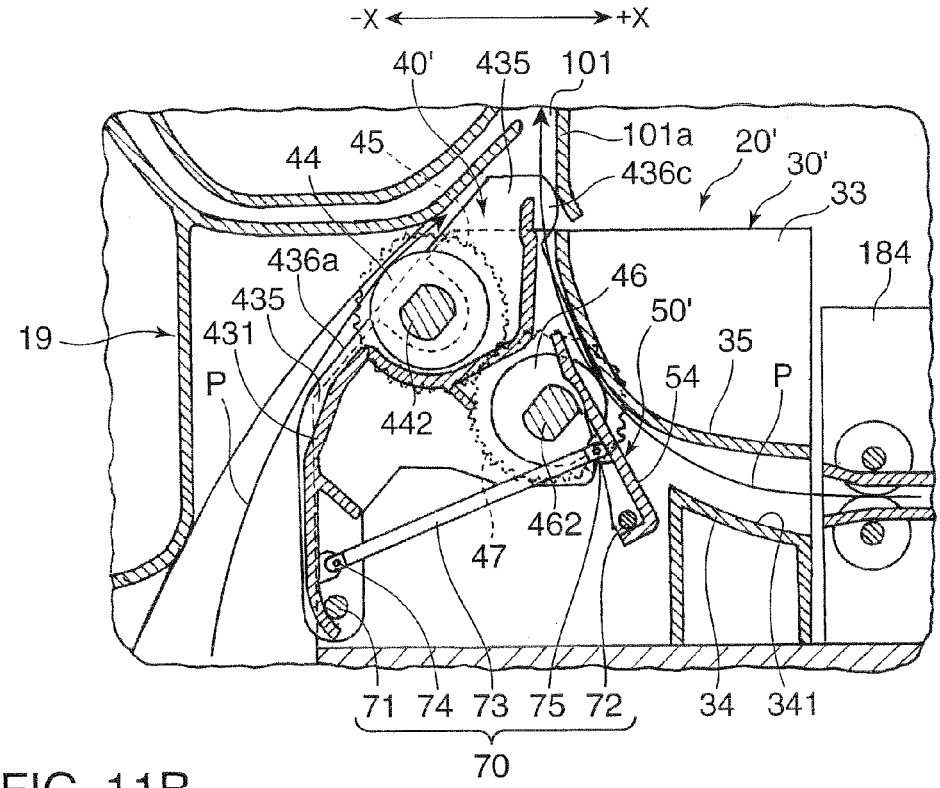
FIG. 11A is a diagram for describing an operation of a posture shifting mechanism in the relay unit in the second embodiment, specifically showing a state that a first guide unit and a second guide unit are respectively set to a transport posture.
Figure 11B:
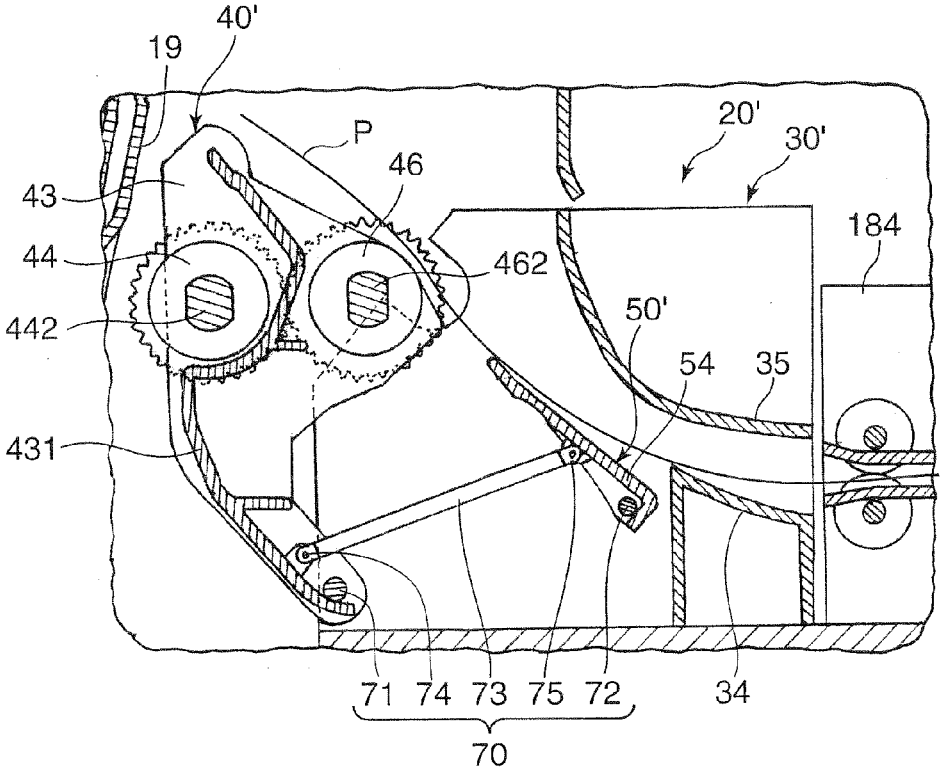
FIG. 11B is a diagram for describing an operation of the posture shifting mechanism in the relay unit in the second embodiment, specifically showing a state that the first guide unit and the second guide unit are respectively set to an open posture.

FIGS. 11A and 11B are diagrams for describing an operation of the posture shifting mechanism 70 in the relay unit 20' of the second embodiment. FIG. 11A shows a state that the first guide unit 40' and the second guide unit 50' are respectively set to the transport posture, and FIG. 11B shows a state that the first guide unit 40' and the second guide unit 50' are respectively set to the open posture. The direction indications by the symbol "X" in FIGS. 11A and 11B are the same as shown in FIG. 1, wherein −X indicates leftward direction, and +X indicates rightward direction.

As shown in FIG. 11A, in the case where the first guide unit 40' and the second guide unit 50' are respectively set to the transport posture, the left ends of the guide fins 435 and the outer surfaces of the first transport rollers 44 in the first guide unit 40' face the right wall of a maintenance door 19 in a closed state; and the right surface of the second guide body 54 and the outer surfaces of the second transport rollers 46 face the arc-shaped portion on the left surface of the upper support frame 35 in the frame unit 30'.

In the above state, a sheet P fed from the sheet cassette 141 is passed through the clearance between the guide fins 435 and the left wall of the maintenance door 19, and is transported toward the photosensitive drum 121 along the vertical transport path 101, while being guided by rotation of the first transport rollers 44.

On the other hand, a sheet P fed from the manual tray 18 to the clearance between the upper support frame 35 and the lower support frame 34 of the relay unit 20' via the transport unit 184 is passed through the clearance between the right surface of the second guide body 54 and the left surface of the upper support frame 35 while being guided along the right surface of the second guide body 54, and is transported toward the photosensitive drum 121 along the vertical transport path 101, while being guided by integral rotation of the second transport rollers 46 about the axis of the second elliptical shaft 462.

In the case where the sheet P fed from the manual tray 18 is jammed in the relay unit 20', the operator opens the maintenance door 19. Then, the first guide unit 40' swings counterclockwise about the axis of the first link shaft 71 shown in FIG. 11A. Then, the linking arm 73 pivotally supported on the third link shaft 74 of the first guide body 43 is moved leftward. Thereby, the second guide unit 50' coupled to the right end of the linking arm 73 via the fourth link shaft 75 swings counterclockwise about the axis of the second link shaft 72 in FIG. 11A. Thereby, the second guide unit 50' is shifted to the open posture, as shown in FIG. 11B.

Then, in the case where the second guide unit 50' is set to the open posture, the clearance between the second guide body 54 and the upper support frame 35 is increased, as shown in FIG. 11B. Thereby, the operator is allowed to easily remove the sheet P jammed in the relay unit 20'. The above arrangement contributes to improving the operability in removing a jammed sheet.

As described above in detail, the image forming apparatus 10 of the embodiment includes the image forming section 12, provided in the apparatus body 11, for forming an image on a sheet P; the maintenance door 19, openably and closably mounted to the apparatus body 11, for exposing the image forming section 12 in an opened state thereof; and the vertical transport path 101 defined by the inner wall of the maintenance door 19 and a portion of the image forming section 12 opposite to the maintenance door 19 to transport the sheet P toward the image forming section 12.

The relay unit 20 in the first embodiment includes: the first guide unit 40 and the second guide unit 50 operable to shift between the proximity position S1 where the first guide unit 40 and the second guide unit 50 are close to each other to guide the sheet P to the vertical transport path 101 while holding the sheet P therebetween, and the away position S2, where the first guide unit 40 and the second guide unit 50 are away from each other to release the sheet P; and the position shifting mechanism 60 for shifting the position of the second guide unit 50 in association with a shifting operation of the first guide unit 40.

According to the above arrangement, in the case where the sheet P to be transported to the image forming position in the image forming section 12 via the vertical transport path 101 is jammed in the vertical transport path 101, the operator is allowed to easily remove the jammed sheet P by opening the maintenance door 19, and exposing the jammed sheet.

In the case where an upstream end of a jammed sheet P is stuck in the space between the first guide unit 40 and the second guide unit 50, in response to shifting the first guide unit 40 from the proximate position S1 to the away position S2, the second guide unit 50 is shifted to the away position S2 where the second guide unit 50 is away from the first guide unit 40 in association with the shifting operation of the first guide unit 40. Thereby, the image forming apparatus is brought to a condition that the sheet P jammed during the operation of shifting the first guide unit 40 and the second guide unit 50 to the away position S2 is easily removable. This arrangement enables the operator to easily remove the jammed sheet P by pulling the sheet P from the space between the first guide unit 40 and the second guide unit 50. The above arrangement is advantageous in allowing the operator to easily remove the jammed sheet P, and remarkably improving the operability in removing the jammed sheet P.

In the first embodiment, the opening/closing operation of the maintenance door 19 is associated with the shifting operation of the first guide unit 40 by a biasing force of the torsion spring 65. Accordingly, in the case where a sheet jam has occurred, the operator can easily remove the jammed sheet by opening the maintenance door 19, without operating the first guide unit 40, since the first guide unit 40 and the second guide unit 50 are automatically shifted from the proximate position S1 to the away position S2 in association with the opening operation of the maintenance door 19. The above arrangement enables the operator to efficiently remove the jammed sheet.

In the first embodiment, the position shifting mechanism 60 includes: the first shaft 61 for pivotally supporting the first guide unit 40 about the axis thereof; the guide grooves 311 for guiding the second guide unit 50 in directions toward and away from the first guide unit 40; the torsion spring 65 for urging the first guide unit 40 toward the away position S2; the first gear 63 coaxially mounted on the first shaft 61 to be integrally rotated with the first shaft 61; the second gear 64 in mesh with the first gear 63 and rotated about the axis of the second shaft 62; and the position shifting cams 66 for shifting the second guide unit 50 between the proximate position S1 and the away position S2 along the guide grooves 311 by rotation of the second gear 64, and the first guide unit 40 has such a shape that the first guide unit 40 is set to the proximate position S1 by interference with the maintenance door 19 in a state that the maintenance door 19 is closed.

In the above arrangement, in a state that the maintenance door 19 is closed, the maintenance door 19 interferes with the first guide unit 40. Thereby, the first guide unit 40 is set to the proximate position S1 against the biasing force of the torsion spring 65, and the second guide unit 50 is also set to the proximate position S1 along with the first guide unit 40.

In the above condition, in the case where a sheet P being transported along the transport path is jammed, the operator opens the maintenance door 19 to remove the jammed sheet P. In response to the operation of opening the maintenance door 19, the first guide unit 40 is released from the interference by the maintenance door 19. Thereby, the first guide unit 40 swings about the axis of the first shaft 61 by the biasing force of the torsion spring 65, and is shifted from the proximate position S1 to the away position S2. Then, the rotation of the first shaft 61 is transmitted to the second gear 64 via the first gear 63 for integral rotation of the second gear 64 about the axis of the second shaft 62. The rotation of the second shaft 62 is transmitted to the second guide unit 50 by the position shifting cams 66. Thereby, the second guide unit 50 is moved in a direction away from the first guide unit 50 while being guided in the guide grooves 311.

As described above, the position shifting mechanism 60 for swinging the first guide unit 40 about the axis of the first shaft 61, and shifting the second guide unit 50 in the direction away from the first guide unit 40 is constituted of the first gear 63, and the second gear 64 in mesh with the first gear 63. This arrangement enables to simplify the construction of the position shifting mechanism 60, and shift the first guide unit 40 and the second guide unit 50 between the proximate position S1 and the away position S2.

The image forming apparatus 10 further includes the registration roller pair 142, provided at a position immediately in front of the image forming section 12 in the transport path, for adjusting a timing of feeding the sheet P to the image forming section 12. This arrangement enables to feed the sheet P being transported along the vertical transport path 101 to the image forming section 12 at an appropriate timing after a lead end of the sheet P has reached the registration roller pair 142 by driving the registration roller pair 142. This arrangement is advantageous in performing a proper image forming operation on the sheet P.

A sheet jam is likely to occur in the vicinity of the registration roller pair 142. A sheet jammed in the vicinity of the registration roller pair 142 can be easily removed by shifting the first guide unit 40 and the second guide unit 50 from the proximate position S1 to the away position S2.

In the relay unit 20' of the second embodiment, each of the first guide unit 40' and the second guide unit 50' is allowed to swing individually. The posture shifting mechanism 70 is employed in the second embodiment, in place of the position shifting mechanism 60 in the first embodiment. The posture shifting mechanism 70 is operable to swing the second guide unit 50' in association with a swinging operation of the first guide unit 40' to shift the second guide unit 50' between the transport posture and the open posture. In this arrangement, in the case where a sheet P is jammed on the side of the second guide unit 50', the second guide unit 50' is shifted from the transport posture to the open posture in association with the swinging operation of the first guide unit 40' about the axis of the first link shaft 71. Thereby, the image forming apparatus is brought to a condition that the sheet P jammed on the side of the second guide unit 50' is easily removable. This arrangement enables the operator to remove the jammed sheet P by pulling the sheet P from the side of the second guide unit 50'.

The posture shifting mechanism 70 includes: the first link shaft 71 for pivotally supporting the first guide unit 40' about the axis thereof; the third shaft for pivotally supporting the second guide unit 50' about the axis thereof; and the linking arm 73 extending between the first guide unit 40' and the second guide unit 50' to swing the first guide unit 40' and the second guide unit 50' relative to each other, wherein the linking arm 73, the first guide unit 40', and the second guide unit 50' constitute a four-sided link structure. Providing the four-sided link structure enables to simplify the construction of the posture shifting mechanism 70, and securely and properly move the first guide unit 40' and the second guide unit 50' in association with each other.

The invention is not limited to the foregoing embodiments, but may embrace the following contents.

In the embodiment, the image forming apparatus is a copier. The image forming apparatus is not limited to a copier, but may be a printer for printing an image based on image information from a computer, or a facsimile machine for forming an image based on image information transmitted from a remote device.

In the first embodiment, the first guide unit 40 and the second guide unit 50 are shifted between the proximate position S1 and the away position S2 in association with an opening/closing operation of the maintenance door 19. Alternatively, the first guide unit 40 may be manually shifted from the proximate position S1 to the away position S2, after the maintenance door 19 is opened.

In the first embodiment, the second guide unit 50 is linearly shifted between the proximate position S1 and the away position S2. Alternatively, the second guide unit 50 may swing back and forth about a right end of the horizontal portion 51 as a pivot axis.

In the first embodiment, the guide grooves 311 serve as a guide rail for linearly moving the second guide unit 50. Alternatively, the guide rail may be ribs vertically extending from the side frames 31. In the modification, it is required to form grooves in the second guide unit 50 with which the ribs are slidably contacted.

In the embodiment, the second guide unit 50 is set to the proximate position S1 by a weight thereof. Alternatively, the second guide unit 50 may be set to the proximate position S1 by a biasing force of a biasing member.

In the first embodiment, both of the first shaft 61 and the second shaft 62 are arranged at side portions of the sheet transport path in view of the positional relations of the parts.

In the above arrangement, however, the number of gears may be increased, and the number of parts may be increased accordingly. Also, the phases of the left-side and right-side position changing cams 66 may be required to be adjusted individually, which may increase the number of steps in assembling.

Figure 12A:
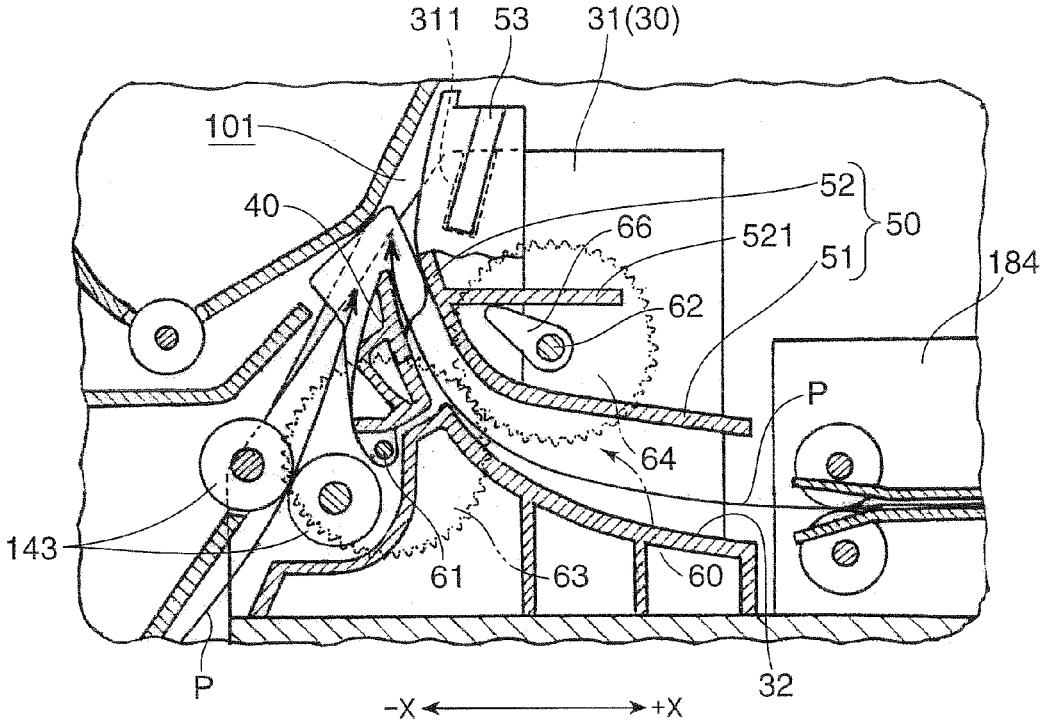
FIG. 12A is a cross-sectional view showing a modification of the position shifting mechanism in the first embodiment, specifically showing a state that a first guide unit and a second guide unit are respectively set to a proximity position.
Figure 12B:
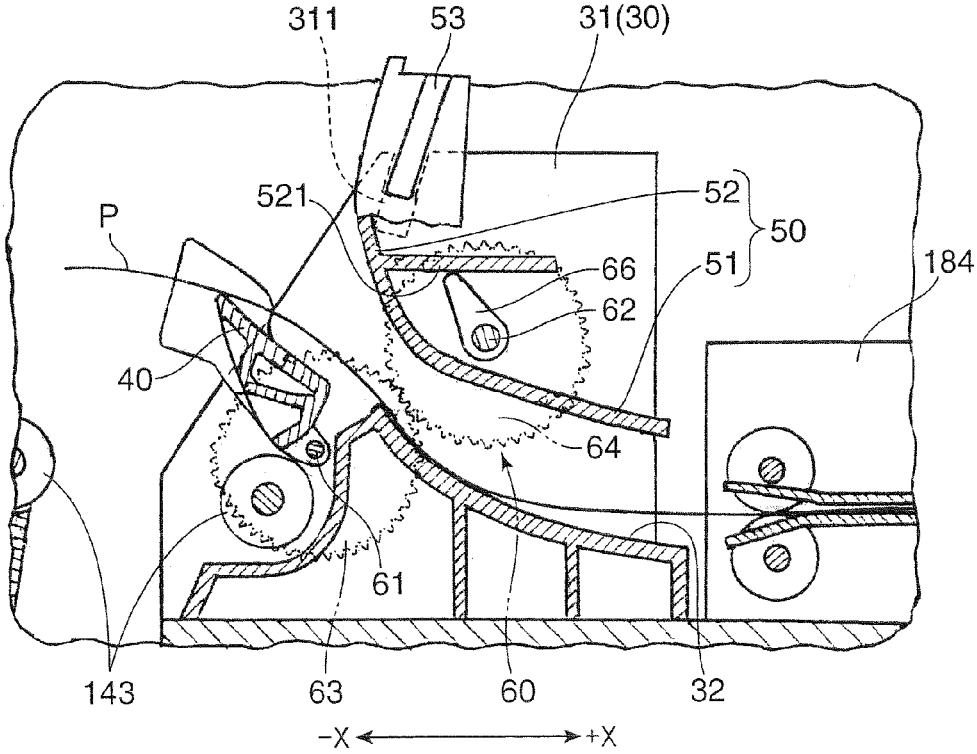
FIG. 12B is a cross-sectional view showing the modification of the position shifting mechanism in the first embodiment, specifically showing a state that the first guide unit and the second guide unit are respectively set to an away position.
Figure 12C:
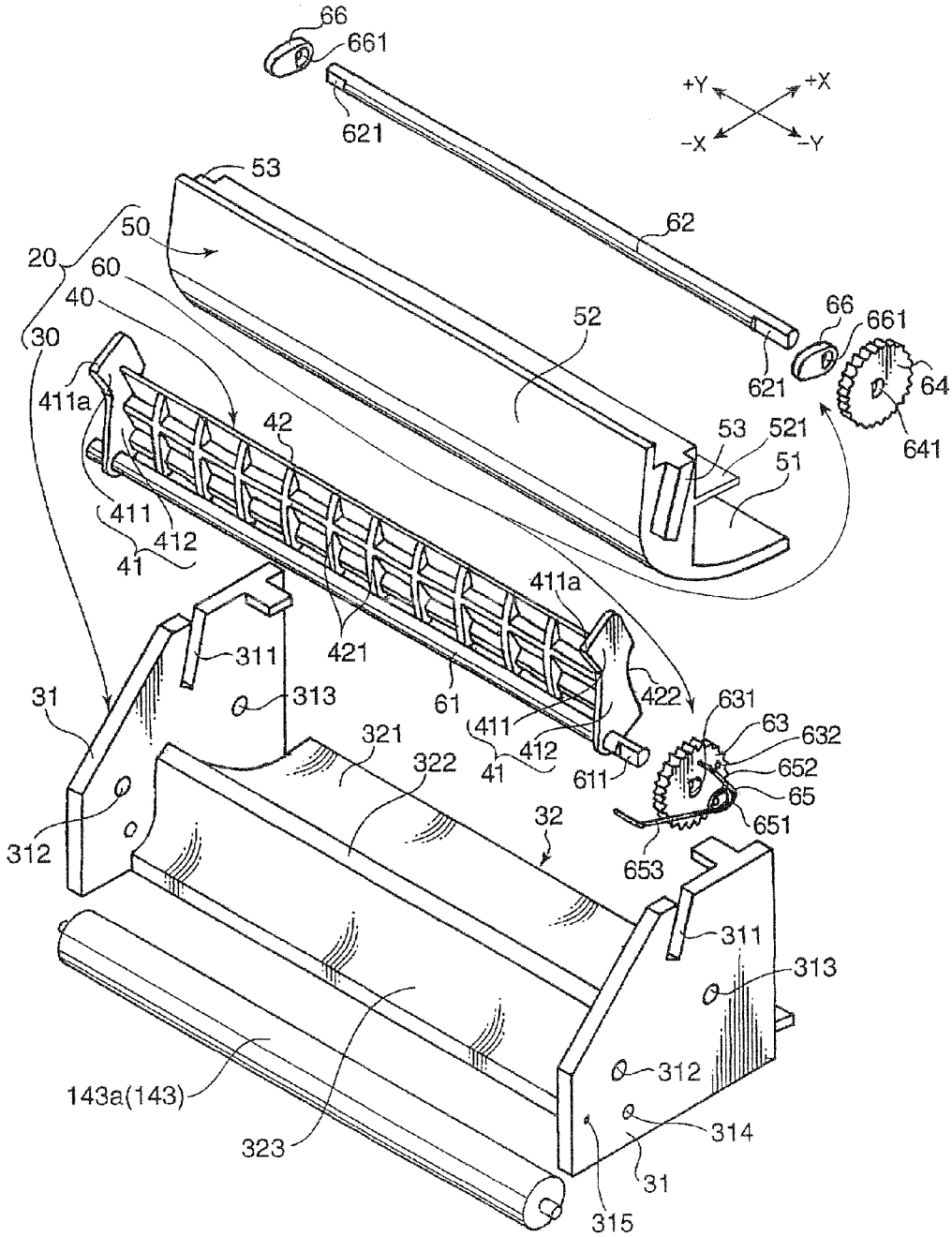
FIG. 12C is an exploded perspective view showing the modification of the position shifting mechanism and the relay unit in the first embodiment.

FIGS. 12A through 12C show an approach for eliminating the above drawback. Specifically, FIGS. 12A and 12B are cross-sectional views showing a modification of the position shifting mechanism 60 in the first embodiment. FIG. 12A shows a state that a first guide unit 40 and a second guide unit 50 are set to a proximate position, and FIG. 12B shows a state that the first guide unit 40 and the second guide unit 50 are set to an away position. FIG. 12C is an exploded perspective view showing the modification of the position shifting mechanism 60 and a relay unit. The direction indications by the symbol "X" in FIGS. 12A and 12B are the same as those in FIGS. 7A and 7B. Specifically, −X indicates leftward direction, and +X indicates rightward direction.

First, as shown in FIG. 12A, a first shaft 61 is arranged at a position displaced from a vertical transport path 101 in rightward direction, and a second shaft 62 is arranged above the second guide unit 50. The first shaft 61 and the second shaft 62 extend through front and rear side frames 31. A D-shaped cutaway portion 611 is formed in a front end of the first shaft 61. Similarly to the first embodiment, a first gear 63 is fixed to the first shaft 61 at a position projecting from the front side frame 31, and a torsion spring 65 is mounted on the first gear 63. A D-shaped cutaway portion 621 is formed at both ends of the second shaft 62. Position changing cams 66 are fixed to the D-shaped cut away portions 621, respectively. The second gear 64 is fixed to the second shaft 62 at a position projecting from the front side frame 31. The second gear 64 is meshed with the first gear 63. A rightwardly extending projecting piece 521 is attached to a vertical portion 52 of the second guide unit 50 to move the second guide unit 50 up an down by rotation of position shifting cams 66. Lead ends of the position shifting cams 66 extending obliquely upwardly in leftward direction from the second shaft 62 are contacted with the backside surface of the projecting piece 521.

The above arrangement enables to prevent a lead end of a sheet P being transported from the sheet cassette 141 (see FIG. 2) along the vertical transport path 101 via a transport roller pair 143 from interfering with the first shaft 61, and prevent a lead end of a sheet P fed from the manual tray 18 (see FIG. 2) to the clearance between a support frame 32 and the second guide unit 50 via a transport unit 184 from interfering with the second shaft 62.

In the modification, similarly to the embodiment, in the case where a sheet jam has occurred, in response to opening the maintenance door 19, a first gear 63 is rotated counterclockwise about the axis of the first shaft 61 by a biasing force of the torsion spring 65 (see FIG. 5). Thereby, the first guide unit 50 swings counterclockwise about the axis of the first shaft 61, and is set to the away position.

Likewise, similarly to the embodiment, in response to rotation of the first gear 63 about the axis of the first shaft 61, the second gear 64 in mesh with the first gear 63 is integrally rotated clockwise about the axis of the second shaft 62. Thereby, the position shifting cams 66 integrally mounted on the second shaft 62 are rotated clockwise. As the position shifting cams 66 are rotated, the lead ends of the position shifting cams 66 lift the projecting piece 521 upwardly. Thereby, the second guide unit 50 is moved upwardly, and is set to the away position, as shown in FIG. 12B.

As described above, an image forming apparatus according to an aspect of the invention includes: an image forming section, provided in an apparatus body, for forming an image on a sheet; a sheet transport path for transporting the sheet to the image forming section; a closing member, openably and closably mounted to the apparatus body, for exposing the sheet transport path in an opened state thereof; a first guide unit and a second guide unit, disposed along the sheet transport path, for guiding the sheet, the first guide unit and the second guide unit being operable to shift between a proximate position where the first guide unit and the second guide unit are close to each other, and an away position where the first guide unit and the second guide unit are away from each other; and a position shifting mechanism for shifting the position of the second guide unit in association with a shifting operation of the first guide unit.

According to the above arrangement, in the case where the sheet to be transported to the image forming position in the image forming section via the sheet transport path is jammed in the sheet transport path, the operator is allowed to easily remove the jammed sheet by opening the closing member and exposing the jammed sheet.

In the case where an upstream end of a jammed sheet is stuck in the space between the first guide unit and the second guide unit, in response to shifting the first guide unit from the proximate position to the away position, the position shifting mechanism is operable to shift the second guide unit to the away position where the second guide unit is away from the first guide unit in association with the shifting operation of the first guide unit. Thereby, the image forming apparatus is brought to a condition that the sheet jammed during the operation of shifting the first guide unit and the second guide unit to the away position is easily removable. This arrangement allows the operator to easily remove the jammed sheet.

In the above arrangement, preferably, the sheet transport path may be constituted of a closing member transport path defining portion defined by an inner wall of the closing member, and a body transport path defining portion defined by a portion of the image forming section opposite to the closing member.

According to the above arrangement, in response to opening the closing member, the sheet transport path is split into the closing member transport path defining portion and the body transport path defining portion. This allows the operator to easily remove the jammed sheet from the sheet transport path.

In the above arrangement, preferably, the closing member may be operable to expose the image forming section along with the sheet transport path in the opened state thereof.

According to the above arrangement, in response to opening the closing member, the operator is allowed to easily remove a sheet jammed in the image forming section, or a sheet jammed in the sheet transport path and the image forming section.

In the above arrangement, preferably, the sheet transport path may include a first transport path for transporting the sheet dispensed from a sheet storing section to the image forming section, and a second transport path for transporting the sheet toward the first transport path in a direction different from the first transport path to change a transport direction, the second transport path joining the first transport path, and the first guide unit and the second guide unit may be provided at a joint portion between the first transport path and the second transport path.

According to the above arrangement, the first guide unit and the second guide unit are provided at the joint portion between the first transport path and the second transport path. The joint portion corresponds to a position where the transport direction of the second transport path is changed. In the case where a sheet is jammed at the joint portion, it is difficult to remove the jammed sheet in a conventional arrangement. In the inventive image forming apparatus, in response to shifting the first guide unit provided at the joint portion from the proximate position to the away position, the position shifting mechanism is operable to shift the second guide unit to the away position where the second guide unit is away from the first guide unit in association with the shifting operation of the first guide unit. Thereby, the image forming apparatus is brought to a condition that the sheet jammed at the joint portion is easily removable. This arrangement enables the operator to easily remove the jammed sheet.

In the above arrangement, preferably, the second transport path may be adapted to transport the sheet from a manual tray mounted on the apparatus body toward the first transport path.

In the above arrangement, preferably, the first guide unit may constitute a part of the first transport path and a part of the second transport path, and the second guide unit may constitute a part of the second transport path.

It is more difficult to remove a sheet jammed at the joint portion from the second transport path, where the transport direction is changed, than from the first transport path. In the above arrangement, the part of the second transport path is defined by the first guide unit and the second guide unit. Accordingly, in the case where a sheet is jammed in the second transport path, in response to shifting the first guide unit from the proximate position to the away position, the position shifting mechanism is operable to shift the second guide unit to the away position where the second guide unit is away from the first guide unit in association with the shifting operation of the first guide unit. Thereby, the image forming apparatus is brought to a condition that the sheet jammed in the second transport path at the joint portion is easily removable. This arrangement enables the operator to easily remove the jammed sheet.

In the above arrangement, preferably, an opening/closing operation of the closing member may be associated with the shifting operation of the first guide unit.

According to the above arrangement, in the case where a sheet jam has occurred, the operator can remove the jammed sheet by opening the closing member, without operating the first guide unit, since the first guide unit and the second guide unit are automatically shifted from the proximate position to the away position in association with the opening operation of the closing member. The above arrangement enables the operator to efficiently remove the jammed sheet.

In the above arrangement, preferably, the position shifting mechanism may include: a first shaft for pivotally supporting the first guide unit about an axis thereof; a guide rail for guiding the second guide unit in directions toward and away from the first guide unit; a biasing member for urging the first guide unit toward the away position; a first gear coaxially mounted on the first shaft to be integrally rotated with the first shaft; a second gear in mesh with the first gear and rotated about an axis of a second shaft; and a position shifting member for shifting the second guide unit between the proximate position and the away position along the guide rail by a rotation of the second gear, and the first guide unit may include an operated portion operable to be set to the proximate position by interference with the closing member in a state that the closing member is closed.

According to the above arrangement, in a state that the closing member is closed, the closing member interferes with the first guide unit. Thereby, the first guide unit is set to the proximate position against the biasing force of the biasing member, and the second guide unit is also set to the proximate position along with the first guide unit.

In the above condition, in the case where a sheet being transported along the sheet transport path is jammed, the operator opens the closing member to remove the jammed sheet. In response to the operation of opening the closing member, the operated portion of the first guide unit is released from the interference by the closing member. Thereby, the first guide unit swings about the axis of the first shaft by the biasing force of the biasing member, and is shifted from the proximate position to the away position. Then, the rotation of the first shaft is transmitted to the second gear via the first gear for integral rotation of the second gear about the axis of the second shaft. The rotation of the second shaft is transmitted to the second guide unit by the position shifting member. Thereby, the second guide unit is moved in a direction away from the first guide unit while being guided in the guide rail.

As described above, the position shifting mechanism for swinging the first guide unit about the axis of the first shaft, and shifting the second guide unit in the direction away from the first guide unit is constituted of the first gear, and the second gear in mesh with the first gear. This arrangement enables to simplify the construction of the position shifting mechanism, and easily and securely shift the first guide unit and the second guide unit between the proximate position and the away position.

In the above arrangement, preferably, the position shifting member may be an eccentric cam to be rotated by the rotation of the second gear to displace the second guide unit in contact therewith. This arrangement enables to simplify the construction of the position shifting mechanism.

In the above arrangement, preferably, the guide rail may have such a shape that the proximate position of the second guide unit is set below the away position of the second guide unit so that the second guide unit is set to the proximate position by a weight thereof.

According to the above arrangement, since the second guide unit is set to the proximate position by the weight thereof, there is no need of providing an additional member (a biasing member or the like) for setting the second guide unit to the proximate position. This is advantageous in simplifying the construction of the image forming apparatus.

In the above arrangement, preferably, the first shaft and the second shaft may be provided outside the sheet transport path.

According to the above arrangement, since the first shaft and the second shaft are provided outside the sheet transport path, there is no likelihood that a sheet may be jammed resulting from collision of the sheet against the first shaft or the second shaft.

An image forming apparatus according to another aspect of the invention includes: an image forming section, provided in an apparatus body, for forming an image on a sheet; a sheet transport path for transporting the sheet to the image forming section; a closing member, openably and closably mounted to the apparatus body, for exposing the sheet transport path in an opened state thereof; a first guide unit, disposed along the sheet transport path and opposite to the closing member, for guiding the sheet, the first guide unit being operable to shift between a transport posture where the sheet is transportable, and an open posture where the sheet is removable; a second guide unit disposed opposite to the closing member with respect to the first guide unit; a posture shifting mechanism for shifting the posture of the second guide unit in association with a shifting operation of the first guide unit.

According to the above arrangement, in the case where a sheet to be transported to the image forming position in the image forming section via the sheet transport path is jammed on the side of the first guide unit in the sheet transport path, the operator is allowed to easily remove the jammed sheet by opening the closing member and exposing the jammed sheet.

In the case where a sheet is jammed on the side of the second guide unit, swinging the first guide unit about the axis of the first shaft allows the second guide unit to shift from the transport posture to the open posture in association with the swinging operation of the first guide unit. Thereby, the image forming apparatus is brought to a condition that the sheet jammed on the side of the second guide unit is easily removable. This arrangement allows the operator to easily remove the jammed sheet by pulling the sheet from the side of the second guide unit.

In the above arrangement, preferably, the posture shifting mechanism may include: a first shaft for pivotally supporting the first guide unit about an axis thereof; a third shaft for pivotally supporting the second guide unit about an axis thereof; and a linking arm extending between the first guide unit and the second guide unit to swing the first guide unit and the second guide unit relative to each other, wherein the linking arm, the first guide unit, and the second guide unit constitute a four-sided link structure.

According to the above arrangement, the posture shifting mechanism has the four-sided link structure constituted of the linking arm, the first guide unit, and the second guide unit. This arrangement enables to simplify the construction of the posture shifting mechanism, and securely and properly move the first guide unit and the second guide unit in association with each other.

In the above arrangement, preferably, the image forming apparatus may further include a registration roller pair, provided at a position immediately in front of the image forming section in the sheet transport path, for adjusting a timing of feeding the sheet to the image forming section.

According to the above arrangement, the sheet being transported along the sheet transport path is fed to the image forming section at an appropriate timing after the lead end of the sheet has reached the registration roller pair by driving the registration roller pair. This arrangement is advantageous in performing a proper image forming operation on the sheet.

A sheet jam is likely to occur in the vicinity of the registration roller pair. A sheet jammed in the vicinity of the registration roller pair can be easily removed by shifting the first guide unit and the second guide unit from the proximate position to the away position.

This application is based on Japanese Patent Applications No. 2007-293376 and No. 2008-26975 filed on Nov. 12, 2007 and Feb. 6, 2008, respectively, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image forming section, provided in an apparatus body, for forming an image on a sheet;

a sheet transport path for transporting the sheet to the image forming section;

a closing member, openably and closably mounted to the apparatus body, for exposing the sheet transport path in an opened state thereof;

a first guide unit and a second guide unit, disposed along the sheet transport path, for guiding the sheet, the first guide unit and the second guide unit being operable to shift between a proximate position where the first guide unit and the second guide unit are close to each other, and an away position where the first guide unit and the second guide unit are away from each other; and a position shifting mechanism for shifting the position of the second guide unit in association with a shifting operation of the first guide unit, wherein the sheet transport path includes a first transport path for transporting the sheet dispensed from a sheet storing section to the image forming section, and a second transport path for transporting the sheet toward the first transport path in a direction different from the first transport path to change a transport direction, the second transport path joining the first transport path, the first guide unit and the second guide unit are provided at a joint portion between the first transport path and the second transport path, the first guide unit constitutes a part of the first transport path and a part of the second transport path, and the second guide unit constitutes a part of the second transport path, the first guide unit is pivotally supported about an axis, and the second guide unit is movable along a guide rail, or pivotally supported about an axis and the position shifting mechanism moves the position of the second guide unit in the direction of moving away from the sheet transport path or pivots the second guide unit in an opposite direction in association with the pivoting movement of the first guide unit in the direction of moving away from the sheet transport path.

2. The image forming apparatus according to claim 1, wherein the sheet transport path is constituted of a closing member transport path defining portion defined by an inner wall of the closing member, and a body transport path defining portion defined by a portion of the image forming section opposite to the closing member.

3. The image forming apparatus according to claim 1, wherein the closing member is operable to expose the image forming section along with the sheet transport path in the opened state thereof.

4. The image forming apparatus according to claim 1, wherein the second transport path is adapted to transport the sheet from a manual tray mounted on the apparatus body toward the first transport path.

5. The image forming apparatus according to claim 1, wherein an opening/closing operation of the closing member is associated with the shifting operation of the first guide unit.

6. An image forming apparatus, comprising:

an image forming section, provided in an apparatus body, for forming an image on a sheet;

a sheet transport path for transporting the sheet to the image forming section;

a closing member, openably and closably mounted to the apparatus body, for exposing the sheet transport path in an opened state thereof;

a first guide unit and a second guide unit, disposed along the sheet transport path, for guiding the sheet, the first guide unit and the second guide unit being operable to shift between a proximate position where the first guide unit and the second guide unit are close to each other, and an away position where the first guide unit and the second guide unit are away from each other; and a position shifting mechanism for shifting the position of the second guide unit in association with a shifting operation of the first guide unit, wherein the sheet transport path includes a first transport path for transporting the sheet dispensed from a sheet storing section to the image forming section, and a second transport path for transporting the sheet toward the first transport path in a direction different from the first transport path to change a transport direction, the second transport path joining the first transport path, the first guide unit and the second guide unit are provided at a joint portion between the first transport path and the second transport path, the first guide unit constitutes a part of the first transport path and a part of the second transport path, the second guide unit constitutes a part of the second transport path, the position shifting mechanism includes:

a first shaft for pivotally supporting the first guide unit about an axis thereof;

a guide rail for guiding the second guide unit in directions toward and away from the first guide unit;

a biasing member for urging the first guide unit toward the away position;

a first gear coaxially mounted on the first shaft to be integrally rotated with the first shaft;

a second gear in mesh with the first gear and rotated about an axis of a second shaft; and a position shifting member for shifting the second guide unit between the proximate position and the away position along the guide rail by a rotation of the second gear, and the first guide unit includes an operated portion operable to be set to the proximate position by interference with the closing member in a state that the closing member is closed.

7. The image forming apparatus according to claim 6, wherein the position shifting member is an eccentric cam to be rotated by the rotation of the second gear to displace the second guide unit in contact therewith.

8. The image forming apparatus according to claim 6, wherein the guide rail has such a shape that the proximate position of the second guide unit is set below the away position of the second guide unit so that the second guide unit is set to the proximate position by a weight thereof.

9. The image forming apparatus according to claim 6, wherein the first shaft and the second shaft are provided outside the sheet transport path.

10. The image forming apparatus according to claim 1, further comprising:

a registration roller pair, provided at a position immediately in front of the image forming section in the sheet transport path, for adjusting a timing of feeding the sheet to the image forming section.

11. An image forming apparatus, comprising:

an image forming section, provided in an apparatus body, for forming an image on a sheet;

a sheet transport path for transporting the sheet to the image forming section;

a closing member, openably and closably mounted to the apparatus body, for exposing the sheet transport path in an opened state thereof;

a joint transport path that joins said sheet transport path;

a first guide unit, disposed along the sheet transport path and opposite to the closing member, for guiding the sheet, the first guide unit being operable to shift between a transport posture where the sheet is transportable, and an open posture where the sheet is removable;

a second guide unit disposed along said joint transport path at a position opposite to the closing member with respect to the first guide unit; and a posture shifting mechanism for shifting the posture of the second guide unit to be closer to said first guide unit in association with a shifting operation of the first guide unit to a released posture of said first guide unit.

12. An image forming apparatus, comprising:

an image forming section, provided in an apparatus body, for forming an image on a sheet;

a sheet transport path for transporting the sheet to the image forming section;

a closing member, openably and closably mounted to the apparatus body, for exposing the sheet transport path in an opened state thereof;

a joint transport path that joins said sheet transport path;

a first guide unit, disposed along the sheet transport path and opposite to the closing member, for guiding the sheet, the first guide unit being operable to shift between a transport posture where the sheet is transportable, and an open posture where the sheet is removable;

a second guide unit disposed opposite to the closing member with respect to the first guide unit; and a posture shifting mechanism for shifting the posture of the second guide unit in association with a shifting operation of the first guide unit, wherein the posture shifting mechanism includes:

a first shaft for pivotally supporting the first guide unit about an axis thereof;

a third shaft for pivotally supporting the second guide unit about an axis thereof; and a linking arm extending between the first guide unit and the second guide unit to swing the first guide unit and the second guide unit relative to each other, wherein the linking arm, the first guide unit, and the second guide unit constitute a four-sided link structure.

13. The image forming apparatus according to claim 12, wherein the sheet transport path is constituted of a closing member transport path defining portion defined by an inner wall of the closing member, and a body transport path defining portion defined by a portion of the image forming section opposite to the closing member.

14. The image forming apparatus according to claim 12, wherein the closing member is operable to expose the image forming section along with the sheet transport path in the opened state thereof.

15. The image forming apparatus according to claim 12, wherein the sheet transport path includes a first transport path for transporting the sheet dispensed from a sheet storing section to the image forming section, and a second transport path for transporting the sheet toward the first transport path in a direction different from the first transport path to change a transport direction, the second transport path joining the first transport path, and the first guide unit and the second guide unit are provided at a joint portion between the first transport path and the second transport path.

16. The image forming apparatus according to claim 15, wherein the second transport path is adapted to transport the sheet from a manual tray mounted on the apparatus body toward the first transport path.

17. The image forming apparatus according to claim 15, wherein the first guide unit constitutes a part of the first transport path and a part of the second transport path, and the second guide unit constitutes a part of the second transport path.

18. The image forming apparatus according to claim 12, further comprising:

a registration roller pair, provided at a position immediately in front of the image forming section in the sheet transport path, for adjusting a timing of feeding the sheet to the image forming section.

* * * * *